US006959984B2

(12) United States Patent
Ogura et al.

(10) Patent No.: US 6,959,984 B2
(45) Date of Patent: Nov. 1, 2005

(54) LIQUID CONTAINER AND INKJET CARTRIDGE

(75) Inventors: Hideki Ogura, Kanagawa (JP); Naoji Otsuka, Kanagawa (JP); Hiroyuki Inoue, Kanagawa (JP); Hiroyuki Ishinaga, Tokyo (JP); Nobuyuki Kuwabara, Tokyo (JP); Tetsuya Ohashi, Chiba (JP); Ryoji Inoue, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,354

(22) Filed: Aug. 12, 2002

(65) Prior Publication Data

US 2003/0035036 A1 Feb. 20, 2003

(30) Foreign Application Priority Data

| | | |
|---|---|---|
| Aug. 14, 2001 | (JP) | 2001-246234 |
| Aug. 14, 2001 | (JP) | 2001-246236 |
| Aug. 14, 2001 | (JP) | 2001-246238 |
| Aug. 14, 2001 | (JP) | 2001-246239 |
| Dec. 27, 2001 | (JP) | 2001-398217 |

(51) Int. Cl.[7] ..... B41J 2/175
(52) U.S. Cl. ..... 347/86
(58) Field of Search ..... 347/85, 86, 87, 347/84; 29/509

(56) References Cited

U.S. PATENT DOCUMENTS

| | | | | |
|---|---|---|---|---|
| 4,422,084 A | | 12/1983 | Saito | 346/140 R |
| 4,509,062 A | | 4/1985 | Low et al. | 346/140 R |
| 4,673,955 A | * | 6/1987 | Ameyama et al. | 347/86 |
| 5,440,333 A | * | 8/1995 | Sykora et al. | 347/87 |
| 5,448,818 A | * | 9/1995 | Scheffelin et al. | 29/509 |
| 5,754,207 A | * | 5/1998 | Gragg et al. | 347/86 |
| 5,767,882 A | * | 6/1998 | Kaplinsky et al. | 347/87 |
| 5,903,292 A | | 5/1999 | Scheffelin et al. | 347/86 |
| 6,053,607 A | | 4/2000 | Kaplinsky et al. | 347/87 |
| 6,247,806 B1 | | 6/2001 | Matsumoto et al. | 347/87 |
| 6,250,751 B1 | | 6/2001 | Whitney et al. | 347/87 |
| 6,345,888 B1 | | 2/2002 | Matsumoto et al. | 347/86 |
| 6,450,631 B1 | | 9/2002 | Hayashi et al. | 347/86 |
| 6,460,984 B1 | | 10/2002 | Matsumoto et al. | 347/86 |
| 2001/0040612 A1 | | 11/2001 | Shimizu | 347/86 |

FOREIGN PATENT DOCUMENTS

| | | |
|---|---|---|
| EP | 583153 | 2/1994 |
| EP | 899112 | 3/1999 |
| EP | 956958 | 11/1999 |
| JP | 56-67269 | 6/1981 |
| JP | 6-226993 | 8/1994 |
| JP | 2000-103078 | 4/2000 |

* cited by examiner

*Primary Examiner*—Anh T. N. Vo
(74) *Attorney, Agent, or Firm*—Fitzpatrick, Cella, Harper & Scinto

(57) ABSTRACT

In a structure of an ink tank having a deformable sheet that constitutes the tank and a spring for imparting a negative pressure, unstableness of the negative pressure attributable to the deformation of the sheet as a result of ink consumption is prevented. For this purpose, a plate-like member is joined to a top section of the sheet formed in a convex shape, and the spring for generating the negative pressure in the tank is mounted to the same member. This makes it possible to maintain a high volume ratio of the ink tank and to achieve stableness of the negative pressure by adequately regulating the deformation of the sheet when the sheet is displaced in the direction of retracting toward the interior of the tank as a result of a reduction of the amount of ink in the tank.

36 Claims, 48 Drawing Sheets

(1) : FIRST LINER REGION
(2) : SECOND LINER REGION
(3) : THIRD LINER REGION
A : CONTACT PORTION

NEGATIVE PRESSURE CHARACTERISTICS BY SHEET

NEGATIVE PRESSURE CHARACTERISTICS BY SPRING

NEGATIVE PRESSURE CHARACTERISTICS BY SPRING AND SHEET

LIQUID CONTAINER AND INKJET CARTRIDGE

This application is based on Japanese Patent Application Nos. 2001-246234 filed Aug. 14, 2001, 2001-246236 filed Aug. 14, 2001, 2001-246238 filed Aug. 14, 2001, 2001-246239 filed Aug. 14, 2001 and 2001-398217 filed Dec. 27, 2001, the content of which are incorporated hereinto by reference.

BACKGROUND OF THE INVENTION

1. Field of the Invention

The present invention relates to a liquid container, e.g., a liquid container that utilizes a negative pressure to supply a liquid such as ink from the inside of the liquid container to a pen or an inkjet recording head as a recording section. The invention also relates to an inkjet cartridge provided by integrating a liquid container as an ink tank and an inkjet recording head.

2. Description of the Related Art

Known containers for containing a liquid include containers that supply a liquid to the outside with a negative pressure maintained inside the containers. A container of this type is characterized in that a liquid can be properly supplied to a liquid-consuming section such as a pen point or recording head connected to the container utilizing a negative pressure applied by the container itself.

The method of supplying a liquid while maintaining a constant negative pressure relative to the outside is well known in the field of inkjet printing. For example, an ink tank can properly supply ink for an ink ejecting operation of a recording head that ejects the supplied ink by maintaining a negative pressure within a predetermined range relative to a pressure in the recording head, and the negative pressure also prevents the leakage of ink from the ink tank itself when the ink tank is treated alone.

An ink supply system extending from a liquid container or ink tank to a recording head is an enclosed system utilizing a tube. In general, in the field of inkjet printing utilizing enclosed ink supply systems, the systems are categorized into systems having a mechanism for generating a negative pressure in a positive way and systems having no such mechanism. Known ink supply systems that utilize no negative pressure generating mechanism include those which utilize "a head difference" (a pressure difference generated by a difference in height between an ink supply system and an ink-consuming section). In this case, since there is no special requirement for such ink tanks except that they must be provided in a position lower than a recording head, they often have configurations like normal bags. However, since the ink supply channel is an enclosed type, there is a need for a supply line such as a tube extending from an ink containing bag to an ink-consuming section (head section) located above the same, which results in a large device. Further, limits are put on the layout of constituent parts to achieve a required head difference.

Under such circumstances, in order to make such an ink supply channel as small as possible or to eliminate the same substantially, structures of recording heads and ink tanks have been proposed and implemented in which a mechanism for generating a pressure that is negative relative to the pressure in a recording head is provided to eliminate a need for a head difference. In this specification, a unit formed by integrating an inkjet recording head and an ink tank is referred to as "inkjet cartridge" or "print head unit".

Such inkjet cartridges having a negative pressure generating mechanism can be categorized into configurations in which a recording head and an ink containing section is always integral with each other and configurations in which a recording head and an ink containing section are separate from each other, are both separable from an apparatus main body, and are integrated with each other for use. In any configuration, an ink supply port of an ink containing section is often provided below the center of the ink containing section in order to improve the utilization of ink contained in the ink containing section. It is necessary also in this respect to supply ink properly by, for example, preventing the leakage of ink from an ejecting section such as a nozzle provided at a recording head and to provide a negative pressure for stably keeping ink in an ink containing section of an inkjet cartridge. The term "negative pressure" means a back pressure associated with the supply of ink to a recording head that is so called because it is generated for making a pressure at an ejection port section of the recording head negative to the atmospheric pressure.

In one specific configuration for generating a negative pressure, a porous member is used to generate a negative pressure by utilizing a capillary force of the same. Specifically, a porous member such as a sponge is contained in an ink tank preferably in a compressed state, and an atmosphere communication port for establishing communication between the interior of the tank and the atmosphere is provided in a position away from an ink supply port.

Negative pressure characteristics of such an ink tank in which a negative pressure is generated utilizing a capillary force of a porous member can be set in adequate ranges by adjusting the capillary force of the porous member itself, which allows ink to be supplied to a recording head with stability.

The ink containing efficiency of such an ink tank utilizing a porous member is basically low because of the presence of the porous member. On the contrary, structures are known in which a porous member is provided such that it occupies only a part of the interior of an ink tank instead of entirely occupying the interior. In this case, the porous member is contained in a part of the ink tank where an ink supply port is provided, and ink is directly contained in a part away from the ink supply port.

This structure makes it possible to achieve higher ink containing efficiency and ink holding capability per unit volume when compared to configurations in which a porous body is inserted such that it occupies an ink tank entirely.

However, the use of a porous member is still unsatisfactory when a further improvement of ink containing efficiency is considered.

On the contrary, bag-shaped containers formed by combining a bag and a spring and ink tanks utilizing an ink container made of rubber are known, and they are regarded as having relatively high containing efficiency because ink is directly contained. For example, known configurations include configurations in which a spring is provided in a bag-shaped ink containing section to provide a force acting against inward deformation of the back as a result of ink extraction, thereby generating a negative pressure (see Japanese Patent Application Laid-open No. 56-67269 (1981) and Japanese Patent Application Laid-open No. 6-226993 (1994)) and configurations in which a conical tip portion of an ink containing section made of rubber having a conical shape is rounded and made thinner than the thickness of a conical circumferential section as disclosed in U.S. Pat. No. 4,509,062.

An ink tank in which a spring is used in a bag-shaped ink container to generate a negative pressure is advantageous in that negative pressure designing can be more easily achieved than using a porous member because a reaction force of the spring in contact with a sheet of the bag is used by converting it into a negative pressure and because the negative pressure can be adjusted by designing the spring appropriately.

However, such an ink tank in the related art utilizing a spring and a sheet may have a problem associated with negative pressure characteristics of the same in that the range in which ink can be supplied with a stable negative pressure is small or in that the behavior of the negative pressure is unstable.

Ink tanks in the related art utilizing a spring and a sheet include ink tanks having a relatively large capacity (in the range from 30 to 40 cc, for example). The shape of the sheet material of such a tank is likely to vary for reasons associated with manufacture, and this results in high possibility of variations of the shape of the sheet material when ink is extracted. Consequently, the negative pressure may be out of a certain preferable range when ink is extracted in many regions, and negative pressure characteristics during ink extraction may vary from tank to tank or between ink supplying actions. This may result not only in unstable ink supply but also in an increase in the amount of extracted ink in regions where an initial negative pressure is not in the preferable range, for example.

An ink tank having a relatively large capacity is practicable in spite of the fact that it still has variations and unstableness as described above because the force of the spring to generate a negative pressure is great and the rigidity of the sheet that changes according to the amount of ink is therefore relatively small.

However, the above-mentioned problem becomes more significant when such a configuration in the related art is used for an ink container having a relatively small capacity (e.g., a capacity up to 30 cc). In particular, since the amount of ink that is used under a negative pressure in an unpreferred range increases, it may not be possible to extract a sufficient amount of ink in a preferable state of supply.

That is, when an ink container having a relatively small capacity is used, since a spring force for generating a required negative pressure is small, there is a relative increase in the influence of the rigidity of the sheet of the container on the spring force during negative pressure designing, which results in a need for paying attention to both of the spring force and rigidity of the sheet.

When such an ink container having a small capacity (e.g., a capacity up to 30 cc) is manufactured from a sheet by inflating a planar sheet and bonding or welding the same to a frame while maintaining the inflated shape, stability of assembly and reliability of bonding may be reduced because of wrinkles formed on the bonded or welded surface. Such a method of manufacture may result in a reduction of yield or variation of the ink capacity itself.

In the case of an ink tank in which no spring is provided and in which a negative pressure is generated by changing the thickness of the sheet to control the rigidity of the sheet, a problem arises in that the deformation of the sheet as a result of ink consumption likely to vary and in that the variation of the negative pressure becomes more significant when changes in the sheet rigidity according to the ambient temperature are taken into consideration.

When a liquid container as described above is stored or left unused for a long time, since a negative pressure exists in the ink tank, gases such as oxygen and nitrogen pass through the sheet and frame member to enter the ink tank. In such a case, in the case of an open type or semi-enclosed type liquid container, there is no need for considering an effect of increasing the internal pressure of the liquid container that is attributable to storage for a long time or changes in the atmospheric pressure because a part of the container is in communication with the atmosphere. In the case of an enclosed type liquid container, however, ink meniscuses can be broken to lead to leakage of ink from the ink ejection port when the internal pressure of the container increases to reach or exceed a meniscus holding pressure at the ejection port as a result of inflow of gasses.

In particular, except for soft films used in the related art taking gas blocking properties into consideration, the gas blocking properties of materials used for a rigid structural member forming an ink container or recording head may not be so good because they are selected for less influence on ink and capability of being bonded to a sheet. In this case, there is considered a remarkable relation between permeation of gases through the rigid structural member and an increase in the internal pressure of the liquid container.

When a sponge as a negative pressure generation source is contained in a liquid container, gasses that enter cells of the sponge as a result of a reduction in the amount of ink therein serve as a material for buffering an increase of the internal pressure. However, in the case of a liquid container constituted by a spring and a resin sheet, gasses will significantly contribute to an increase of the internal pressure of the container when attention is paid to the fact that only a liquid exists in the same and that the interior is in a sealed state.

In addition, there is a need for suppressing evaporation of moisture that passes through a member used for a liquid container in order to prevent any increase in the density of a liquid in the container.

Referring to configurations of such springs, coil springs and leaf springs are primarily used. In the case of a coil spring, sections of the coil pile up on one another in a compressed state when a moving section is deformed and closed as ink is consumed, which results in a thickness equivalent to the coil diameter multiplied by the number of turns of the same. This increases a dead space in an ink tank and adversely affects ink utilization. Japanese Patent Application Laid-open No. 2000-103078 has proposed a configuration in which a leaf spring having a plurality of bent sections. When a plurality of bent sections and a leaf spring are used, there will be a great spring load, which is unpreferred in that a negative pressure that is greater than an adequate value is generated especially when an ink tank is configured compactly.

On the contrary, a semi-elliptic spring has been proposed in Japanese Patent Application Laid-open No. 6-226993 (1994). According to the publication, the shape of the semi-elliptic spring is not complicated, and the spring load can be set with a certain degree of freedom according to parameters such as the thickness and material of the spring.

It is uncertain whether the semi-elliptic spring disclosed in the above-cited publication has a plate-like configuration or a linear configuration. In either case, a spring that is a single member is bent near the center thereof to generate a spring force through such bending. When a deforming load is repeatedly applied to the spring, fatigue occurs at the bent portion, which can finally result in breakage. Further, the spring must have a certain radius of curvature to be bent, which results in a dead space that is equivalent to the radius of curvature when the spring is completely compressed just as in the case of the use of a coil spring.

Specifically, a semi-elliptic spring is not suitable for an ink tank having a configuration in which ink is repeatedly charged and used, and it also has problems to be solved with respect to ink utilization. While the same publication has disclosed a configuration in which movable parts are formed symmetrically on both sides of a semi-elliptic spring, a force to deform the movable parts can act off balance because of the presence of a bent portion, which can result in unstable deformation of the movable parts or can cause variations of deformation of the movable part on one side to adversely affect the movable part on the other side through the semi-elliptic spring. Resultant fluctuations of the pressure in the ink tank can act on the printing head through the ink supply channel to adversely affect the ejecting performance.

Inkjet printing apparatus for forming an image on a printing medium by applying ink to the printing medium using an inkjet printing head include apparatus which forms an image by ejecting ink while moving a printing head relative to a printing medium and apparatus which forms an image by ejecting ink while moving a printing medium relative to a fixed printing head.

The significant recent trend toward color recording techniques has resulted in the advent of inkjet recording apparatus that have a plurality of ink tanks in order to render a plurality of colors. In inkjet recording apparatus according to the related art having a plurality of ink tanks, configurations are employed in which a plurality of ink tanks are held by an integral holding member and in which partition walls for preventing interference between the ink tanks are disposed in the holding member to allow each of the ink tanks to have an independent and stable ink containing volume and ink supplying performance, thereby keeping each of the ink tanks in an independent state. Alternatively, a holding member itself may be independently configured for each color and independently and detachably fixed to a fixing member at a recording apparatus main body.

However, a configuration in which a plurality of ink tanks are provided for color recording results in an increase in the size of an apparatus in contradiction to needs for more compact recording apparatus. Although efforts have been made to provide a plurality of ink tanks close to each other for this reason, it is rather difficult to provide a plurality of ink tanks close to each other because of mechanical restrictions placed by an ink supply connecting section on a printing head main body for ejecting ink in each color. When an ink tank or container for each color can be replaced independently, since restrictions are placed on the position of an ink supply connecting section in order to supply ink to a printing head main body with reliability, ink tanks have been kept separate from each other by partitions with some degree of freedom to prevent interference between them in order to give priority to the reliability of ink supply.

The above-described arrangements create a problem especially when a configuration is adopted in which ink is supplied by attaching ink tanks integrally with or detachably from a printing head that is mounted on a carriage to be moved back and forth (main scanning). Specifically, when members moving with a carriage (a printing head and ink tanks undetachably or detachably integrated with the same) have a large projected area in the direction of a plane perpendicular to the direction of main scanning or a large volume, a grate space will be required for main scanning, which will result in an increase in the size of the apparatus as a whole.

SUMMARY OF THE INVENTION

The invention has been made taking the above-described problems into consideration to ahieve at least one of the following purposes.

There is provided a liquid container having a deformable sheet that forms a part of the container and a spring for imparting a negative pressure, and an inkjet cartridge utilizing the container, the liquid container allowing small capacity ink tanks to be provided with stable productivity and a stable capacity.

A planar member is secured to a surface of a convex apex formed on the sheet member in advance, the planar member is in contact with the spring to stabilize deformation of the sheet and stabilize a negative pressure.

There is provided a liquid container, an inkjet cartridge, and an inkjet recording apparatus in which a liquid can be supplied in a wide region with a negative pressure in a predetermined preferable range when the ink is extracted and which exhibit stable negative pressure characteristics.

There is provided a liquid container whose gas blocking properties are prevented from being deteriorated for a long time with a simple structure.

There is provided an ink tank having a structure that exhibits high durability even when ink is repeatedly charged and used, exhibits high ink utilization, and does not adversely affect ejecting performance of a printing head.

There is provided a structure which contributes to an inkjet printing head and a printing apparatus capable of a stable ejecting operation.

There is provided an ink tank container that is compact and simple in configuration even when plural types of inks are to be used, thereby contributing to an inkjet printing head and a printing apparatus capable of a stable ejecting operation.

In an aspect of the present invention, there is provided a liquid container for reserving a liquid to be supplied to the outside, comprising:

a flexible sheet member that forms a part of the container and that is formed in a convex shape;

a fixing member that forms a part of the container and that is a member for fixing the sheet member at a peripheral section thereof, the fixing member having an opening to allow the liquid to be extracted to the outside; and a spring member provided in a section of the sheet member formed in the convex shape.

With this aspect, since the sheet member is formed with the convex feature, the capacity of even a small capacity ink tank can be stabilized, and the sheet member can be provided with predetermined rigidity. The planarity of the sheet member can be maintained when it is secured to a frame, which improves stability of production because problems such as wrinkles on the welded or bonded surface can be prevented.

In another aspect of the present invention, there is provided a liquid container for supplying a liquid to the outside and for reserving the liquid, comprising:

a movable member that forms the container and that is made of a flexible sheet material; and a negative pressure generating means for applying a force to the movable member to deform it in a direction opposite to the direction in which the movable member is deformed as the liquid is supplied, thereby maintaining a negative pressure in the container relative to atmosphere, wherein negative pressure characteristics that are a relationship between the amount of liquid extracted to be supplied and changes in the negative pressure generated by the negative pressure generating means including a first region and a second region having a rate of change of the negative pressure smaller than that in the first region.

With this aspect, negative pressure characteristics representing a relationship between the amount of extracted liquid or ink and a negative pressure include a first region and a second region in which the rate of change of the negative pressure is smaller than that in the first region. Alternatively, a planar or curved portion at the side of the planar portion of the convex feature of a movable member is deformed, and the convex apex is thereafter displaced against the force of a negative pressure generating unit, which makes it possible to cause a great increase in the negative pressure at the initial phase of ink extraction or in the first region. It is therefore possible to reach a predetermined negative pressure required for supplying ink by extracting a relatively small amount of ink.

In a further aspect of the present invention, there is provided an inkjet head cartridge comprising:

an inkjet head for ejecting ink; and a liquid container according to one of the above aspects for reserving ink to be supplied to the inkjet head.

Incidentally, in the present specification, the wording "printing" (also referred to as "recording" in some occasions) means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" (also referred to as "liquid" in some occasions) should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

Meantime, the present invention may be applied to a printing head in which a thermal energy generated by an electrothermal transducer is utilized to cause a film boiling to liquid in order to form bubbles, a printing head in which an electromechanical transducer is employed to eject liquid, a printing head in which a static electricity or air current is utilized to form and eject a liquid droplet and the others which are proposed in the art of an inkjet printing technology. Specifically, the printing head in which the electrothermal transducer is utilized is advantageously employed to achieve a compact structure.

Still further, the wording "nozzle", as far as not mentioned specifically, represents to an ejection opening, a liquid passage communicated with the opening and an element for generating an energy used for ink, in summary.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Various embodiments of the invention applied to inkjet recording apparatuses will now be described with reference to the drawings.

Figure 1:
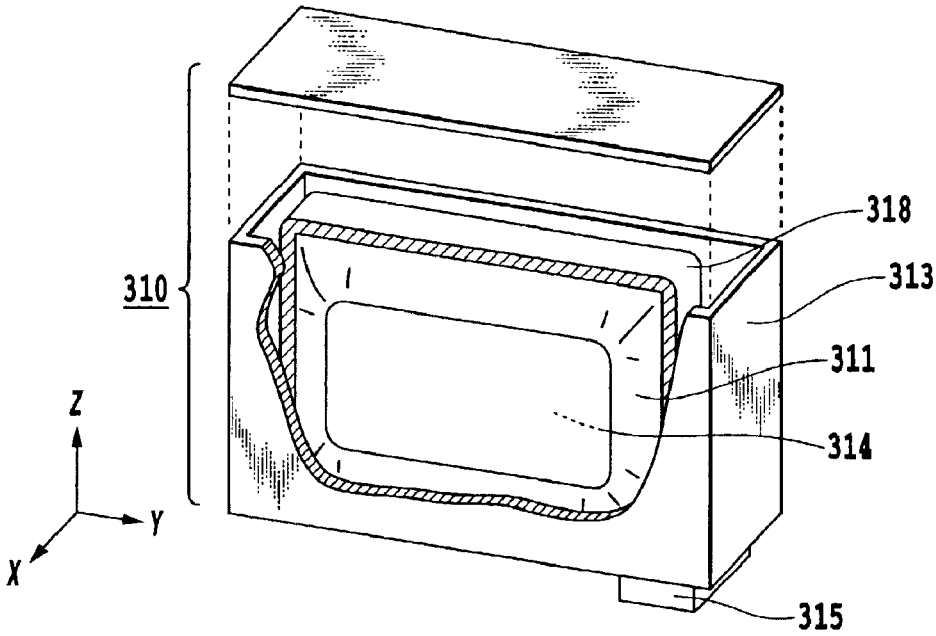
FIG. 1 is a partially cutaway perspective view of an ink container according to an embodiment of the invention.
Figure 2A:
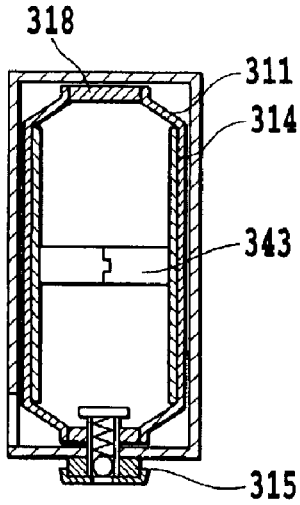
FIGS. 2A, 2B, and 2C are a sectional view of the ink container in FIG. 1 taken on a Z-X plane in the same figure, a sectional view of the same taken on an X-Y plane, and a view of the same in an X-direction taken with an outer casing of the same removed at a side of the same.
Figure 2B:
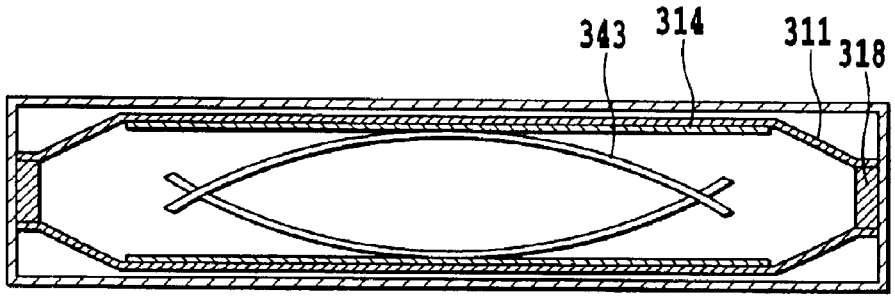
Figure 2C:
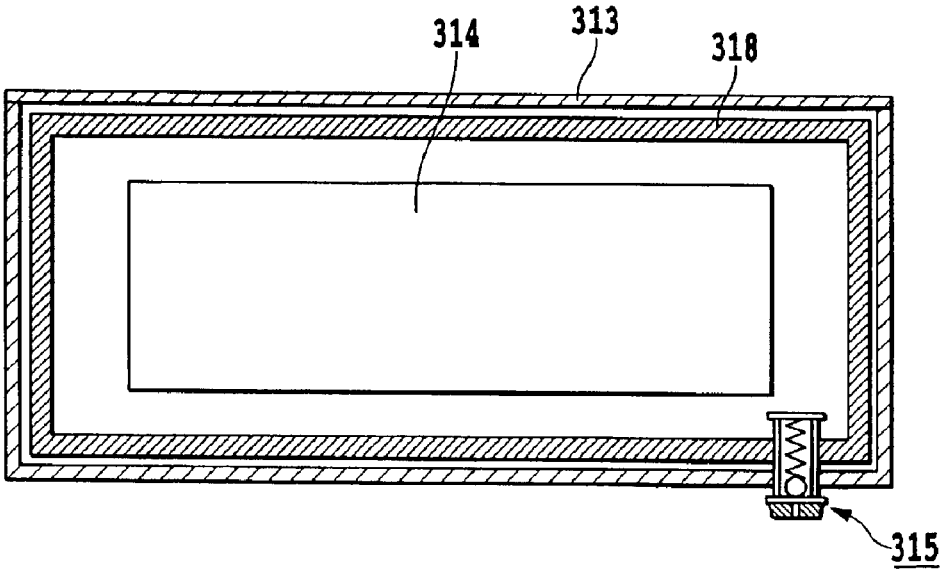

FIG. 1 is a partially cutaway perspective view of an ink or liquid container according an embodiment of the invention. FIGS. 2A, 2B, and 2C are a sectional view of the ink container in FIG. 1 taken on a Z-X plane in the figure, a sectional view of the same taken on an X-Y plane, and a view of the same taken in an X-direction with the outer case removed at one side thereof, respectively.

As shown in those figures, the ink container 310 of the present embodiment has movable members 311 provided on both sides of a frame 318 in the form of a substantially rectangular loop and flat plates 314 mounted to movable members 311. That is, an ink containing space is formed by those members. An outer case 313 of the ink container 310 serves as a shell for protecting the members such as the movable members 311 against an external force.

The movable members 311 are deformable flexible films (sheet members) that are formed into a convex shape, and they have a substantially trapezoidal side sectional configuration (see FIGS. 2A and 2B). The plates (planar members) 314 are attached to the entire tops of the convex features to limit the shape of the same such that they become flat surfaces, and peripheral sections of the convex features are obtained by forming sheet members such that they form side sections of the convex features. That is, the movable members 311 exhibit certain rigidity at the beginning of deformation of the same because the side sections of the convex features are formed. A combination of two leaf springs 343 is provided in the containing space. Each of the springs 343 substantially forms a part of an arc and, when the combination of the springs is flattened by a force from the plates 314 that are in contact therewith, an elastic force is generated according to the displacement. A combined action of the movable members 311 and the springs 343 makes it possible to achieve negative pressure characteristics as will be described later. When the pressure of gases in the containing space is increased as a result of an increase in the ambient temperature, the movable members 311 are displaced outward to allow the gases in the containing space to expand. Incidentally, it is preferred to form the pair of springs in a shape enabling a smooth deformation in a direction of becoming flat at least when the springs are placed in the ink tank. For instance, each of said springs is preferred to have a general U-shape or an arc-shape having central angle of 180 degrees.

An ink supply port 315 is connected to a joint of a recording head, which makes it possible to supply ink from the ink container to the recording head.

Figure 3:
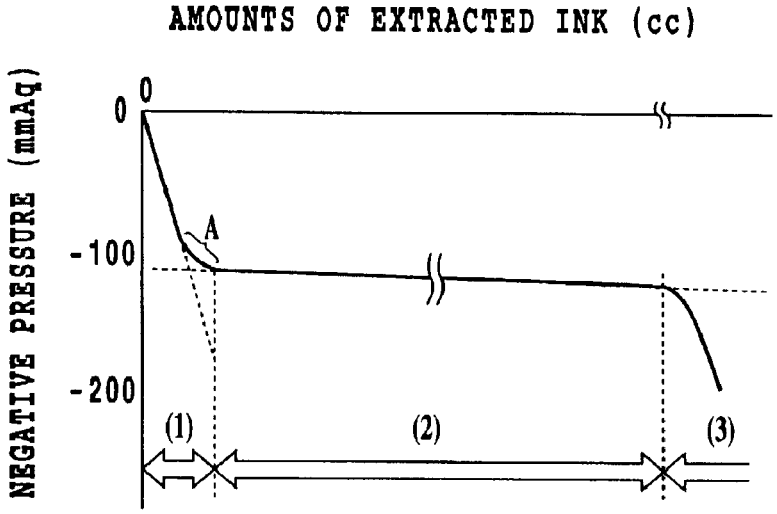
FIG. 3 shows an idealistic negative pressure characteristic curve obtained in a containing space of an ink container.

FIG. 3 illustrates an idealistic negative pressure characteristic curve that is obtained in the containing space of the ink container according to the invention. In this figure, amounts of extracted ink are shown along the abscissa axis, and negative pressures generated in the container are shown along the ordinate axis.

As shown in this figure, the negative pressure characteristics are generally classified into three linear regions (1), (2), and (3). The first linear region (1) is a region in which the negative pressure is relatively rapidly increased (i.e., an absolute pressure is relatively rapidly decreased) at the beginning of use of ink (0 cc), and the second linear region (2) is a region in which there is a little change in the negative pressure as a result of ink extraction. The third linear region (3) is a region in which the negative pressure is rapidly increased. The two straight lines in the first and second linear regions indicating respective linear relationships are connected to each other at a contact region A or a predetermined curve.

First, an idealistic negative pressure characteristics of the invention is that the range of the first linear region is made as short as possible to quickly enter the second linear region. That is, the negative pressure is relatively rapidly increased to a predetermined initial negative pressure for supplying ink. When this region is small, the second linear region can having stable negative pressure characteristics can be entered by extracting only a small amount of ink. Second, the range of the second linear region is made as long as possible, that is, the negative pressure changes more gently than in the first linear region (with a smaller slope). This means that ink supply can be continued for a long time with a relatively stable negative pressure. When those two characteristics are combined, it is possible to the amount of ink that can be effectively used. As will be described later, the negative pressure characteristics in the first linear region (1) primarily depend on the deformation of the movable members 311, and the negative pressure characteristics in the second linear region (2) depend on the elastic force of the springs 343.

The idealistic negative pressure characteristics of the invention are highly reproducible. In particular, what is important is the reproducibility of the first linear region that affect the occurrence of an initial negative pressure. Such reproducibility also primarily depends on the deformation of the movable members 311.

In order to achieve such reproducibility, the amount of ink extracted in the first linear region is desirably 0.5 cc or less and more preferably 0.2 cc or less regardless of the capacity of the containing space. The amount of ink is desirably at least in the range from 0% to 10% of the ink containing capacity.

Figure 4:
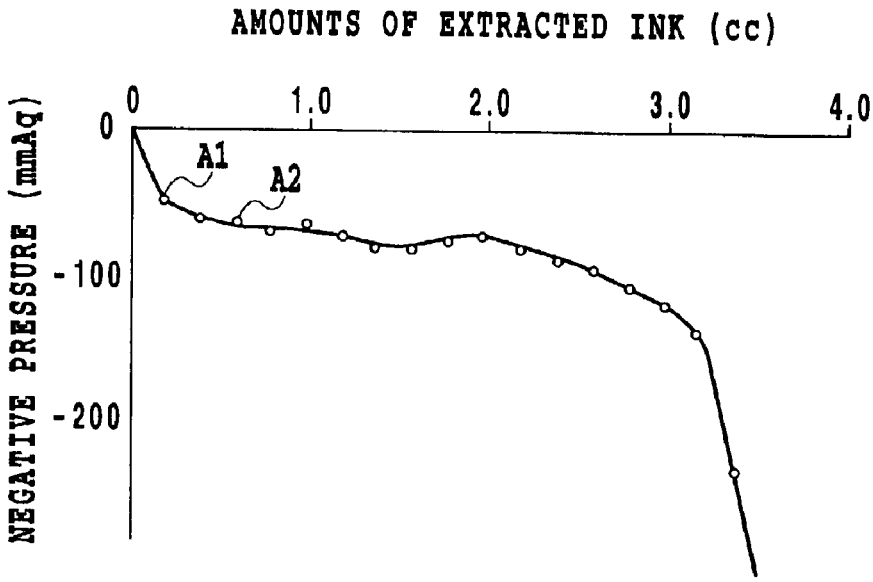
FIG. 4 shows a negative pressure characteristic curve of the ink container of the embodiment shown in FIG. 1 and FIGS. 2A to 2C.

FIG. 4 shows a negative pressure characteristic curve of the ink container of the present embodiment shown in FIG. 1 and FIGS. 2A to 2D.

Apparently, this negative pressure curve is similar to the idealistic negative pressure curve shown in FIG. 3. In other words, the ink container of the present embodiment and, in particular, the movable members 311 and springs 343 are designed to achieve the idealistic negative pressure characteristics shown in FIG. 3. As shown in FIG. 4, there is a region (a first linear region) in which an initial negative pressure is generated by extracting a very small amount (on the order of 0.2 cc) of ink to increase the negative pressure relatively rapidly and a region (a second linear region) in which the negative pressure is stable. That is, two contacts A1 and A2 are observed between two curves (straight lines) that can be regarded as the first linear region and the second liner region and a curve that connect them.

When only a small amount of ink is left in the ink container as a result of further extraction of ink, a third linear region will be observed which is a region where the negative pressure is rapidly increased again. The third linear region is a region in which ink in the container has been substantially entirely extracted and the springs 343 or movable members 311 have become physically difficult to deform to cause a rapid increase in the negative pressure consequently, the region indicating that the ink container has been used up.

Figure 5A:
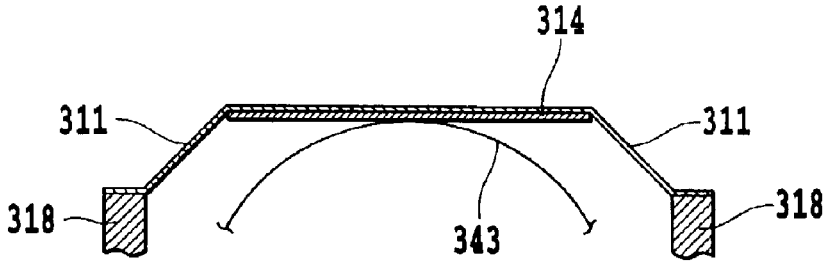
FIGS. 5A to 5D illustrate how negative pressure characteristics are achieved by the ink container of the embodiment shown in FIG. 1 and FIGS. 2A to 2C.
Figure 5B:
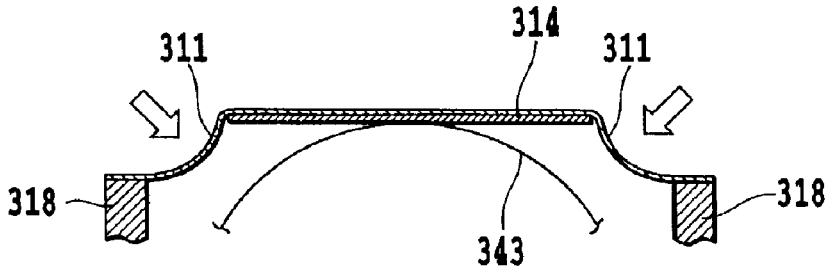
Figure 5C:
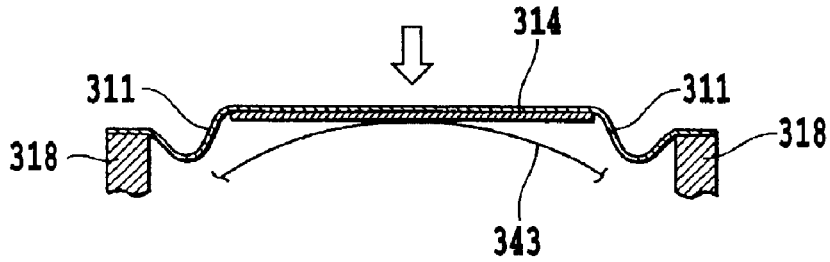
Figure 5D:
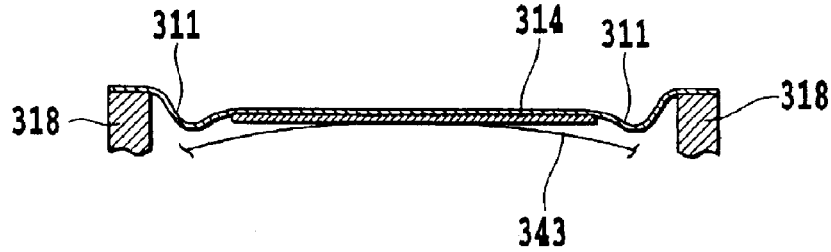
Figure 6:
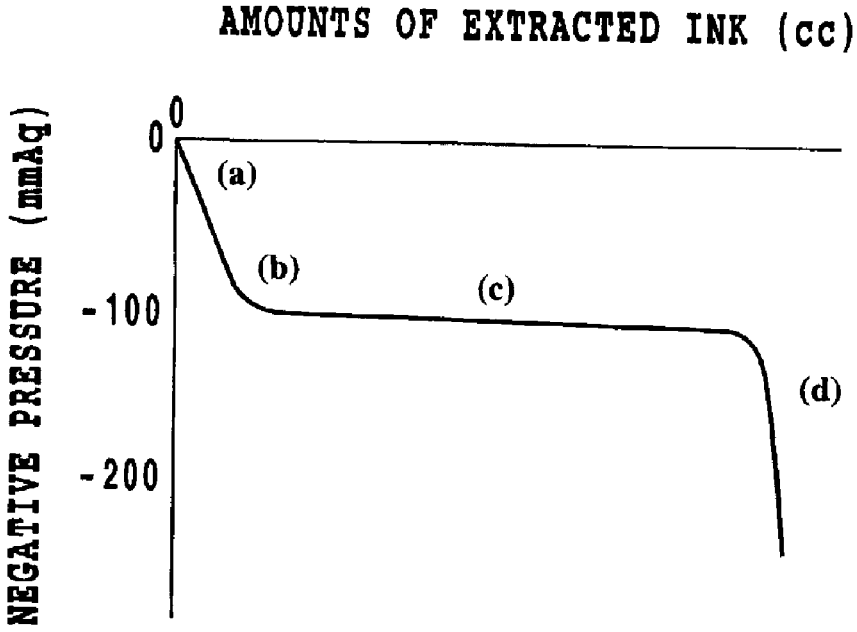
FIG. 6 shows regions of the negative pressure characteristics associated with the states shown in FIGS. 5A to 5D.

FIGS. 5A to 5D illustrate how the above-described negative pressure characteristics are achieved by the ink container of the present embodiment, and FIG. 6 shows regions associated with states of the negative pressure characteristics shown in FIGS. 5A to 5D.

FIG. 5A shows a phase at which the amount of extracted ink is substantially zero at the beginning of use of ink. The movable members 311 are not deformed at this time and, in the subsequent first linear region, substantially no displacement of the plates 314 occurs because the springs 343 exert high stress and the ink is extracted as a result of deformation of small slacks at the side sections supported by the plates 314 and the frame 318. Since the side sections have a uniform surface and have substantially no slack in their original configuration, those sections contribute a little to ink extraction. The reason is that each of the movable members 311 is formed with a side section of a convex feature as described above and that uniform flat surfaces and curved surfaces are obtained through such forming to provide certain rigidity and consistency of the shape. More specifically, since such rigidity substantially eliminates expansion and contraction, deformation as a result of extraction of ink soon reaches saturation and generates a tension. As a result of this, the negative pressure is rapidly increased according to the ink extraction and reaches a predetermined value. The region indicated by (a) in FIG. 6 is a region in which the amount of extracted ink is substantially zero at the beginning of use of ink as described above.

FIG. 5B shows displacement of the movable members at the time when the negative pressure for supplying ink is generated at the beginning of the second linear region after the change in the first linear region as described above. As shown in the same figure, the movable members 311 are not deformed any more at this point in time. Since this results in a very high stress in the excess of the stress exerted by the springs 343, the negative pressure characteristics are dominated by the springs 343 instead of the side sections of the movable members 311. Thereafter, the elastic force of the springs 343 corresponds to the displacement of the plates 314. Thus occurs in the region indicated by (b) in FIG. 6.

FIG. 5C shows displacement of the plates 314 and the springs 343 in a region of a stable negative pressure (second linear region) indicated by (c) in FIG. 6. As shown in the same figure, since the movable members 311 receive continued support of the plates 314 and frame 318 to maintain the tension thereof with the presence of deformation as a result of the displacement of the plates, the displacement in this region only depends on the springs 343. It is therefore possible to set a quite flat rate of change (slope) in the second region or such that a change in the negative pressure is suppressed relative to the amount of extracted ink by designing the springs 343 with an appropriate elastic force. Thus, since there is the contact region A at which the dominant factor for the negative pressure characteristics is switched between the side sections of the movable member 311 and the springs 313, it is possible to carry out independent and optimum designing of the region in which an initial negative pressure is generated by extracting ink to increase the negative pressure relatively rapidly (first linear region) and the region in which the negative pressure is stable (second linear region).

FIG. 5D shows a state of the movable member when only a small amount of ink is left in the ink container and corresponds to the region indicated by (d) in FIG. 6. In this region (third linear region), the ink has been extracted substantially entirely, and displacement of the plates 314 and movable members 311 is substantially disallowed, which results in a rapid increase in the negative pressure.

Figure 7A:
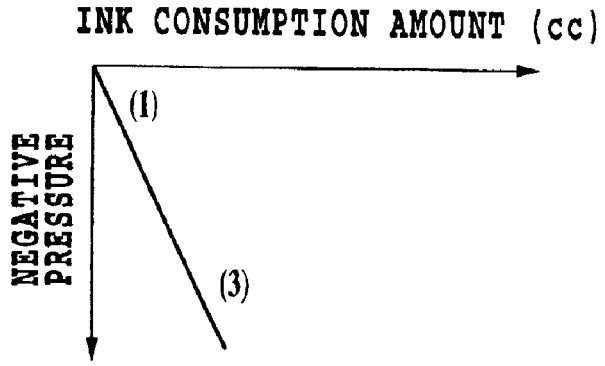
FIGS. 7A to 7C illustrate contributions of a movable member and a spring to negative pressure characteristics.
Figure 7B:
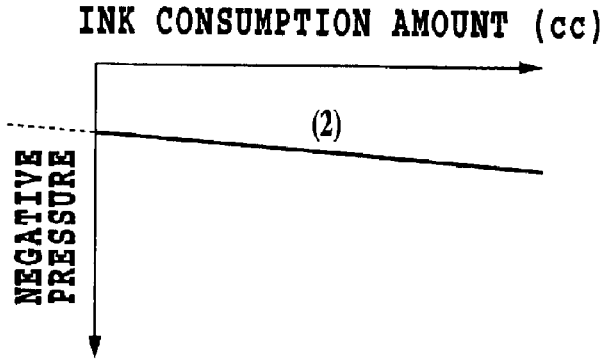

FIGS. 7A to 7B show contributions made by the movable members (sheets) 311 and the springs 343 respectively to negative pressure characteristics that are determined as described above.

Figure 7C:
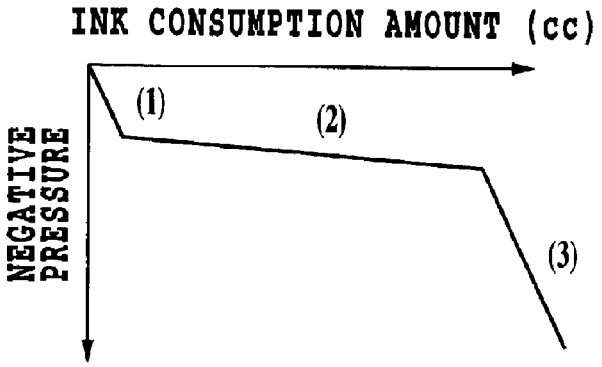

As described above, or as shown in FIG. 7C, the negative pressure characteristics are generally classified into three linear regions (1), (2), and (3). A region (1) is a region that depends on the characteristics of the sheets (movable members) as shown in FIG. 7A (such characteristics are obtained when the springs 343 are replaced with a rigid part that is not deformed at all), and a region (3) is a region that similarly depends on the characteristics of the sheets (or approximated sheet characteristics that are characteristics of the sheets in combination with the springs, strictly speaking). A region (2) is a region that depends on the characteristics of the springs as shown in FIG. 7B (such characteristics are obtained when sheets as movable members having sufficient slacks and no tension at all are attached). FIG. 7C is a combination of FIG. 7A and FIG. 7B and is characteristic of the configuration according to the invention.

Figure 8:
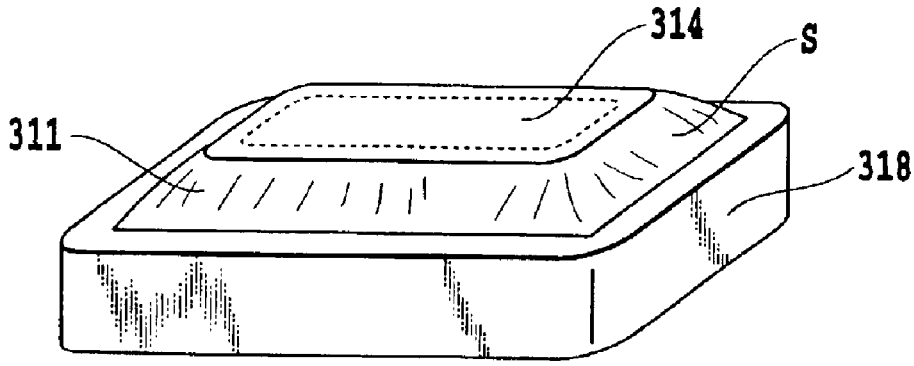
FIG. 8 is a perspective view showing an ink container according to an example for comparison with the embodiment in FIG. 1.
Figure 9:
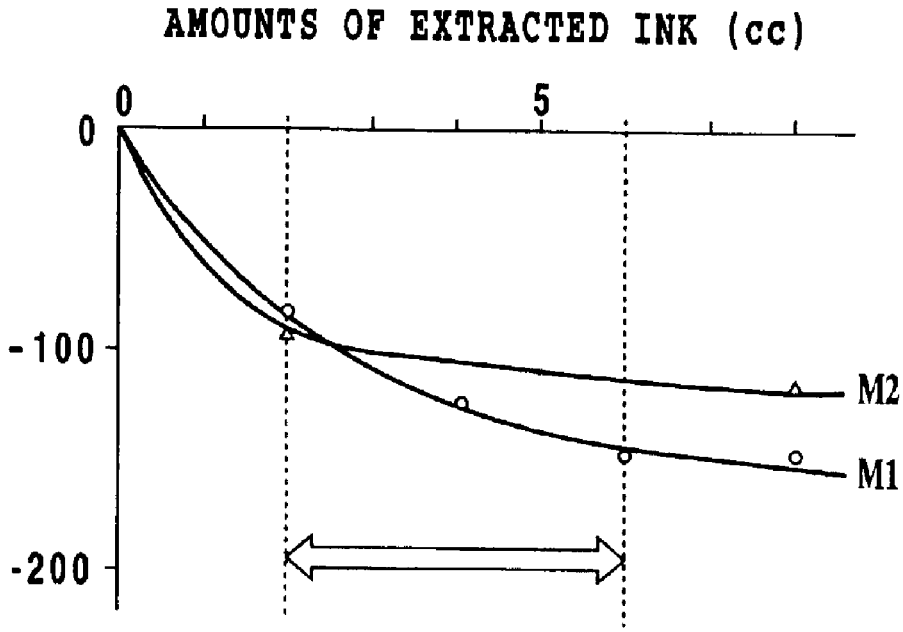
FIG. 9 shows results of two measurements of a negative pressure carried out on an ink container having a structure according to the comparative example.

FIG. 8 is a perspective view of an ink container according to a comparative example. In this structure, movable members are obtained by expanding flat sheet members by injecting ink therein instead of molding or forming them into a convex shape as in the above embodiment. In addition, the movable members have a capacity (30 to 40 cc, for example) that is larger than 30 cc or less in the above embodiment. FIG. 9 shows results of two measurements of a negative pressure carried out on the ink container having such a structure.

As apparent from the negative pressure characteristics shown in FIG. 9, nothing that can be regarded as the contact region in the above embodiment exists in the negative pressure characteristics obtained by either of measurements M1 and M2. Specifically, the negative pressure characteristics of the comparative example are not consisted of two curves (straight lines) having substantially linear characteristics. As a result, a relatively large amount of ink is extracted before a predetermined initial negative pressure suitable for stably supplying ink is reached, and there is substantially no stable region. Therefore, this container will result in a reduction in printing quality attributable to changes in the negative pressure when used for supplying ink to an inkjet head.

It is apparent that the two measurements resulted in negative pressure characteristics different from each other. In particular, a variation in the negative pressure or the amount of extracted ink is observed in the region corresponding to the first linear region where an initial negative pressure has not been reached yet. The example shown in FIG. 9 shows that a variation of about 4 cc has occurred. This indicates that negative pressure characteristics vary from ink container to ink container or change each time ink is supplied after replenishment. On the contrary, since the movable members of the embodiment of the invention are consistent in their shape because they are formed in a convex configuration as described above, they always have a constant shape from which constant negative pressure characteristics can be expected.

Since the ink container of the comparative example is obtained by simply expanding flat sheet members without forming them, it has no predetermined rigidity as in the above embodiment at the initial phase of ink extraction, and it is therefore relatively easily deformed in accordance with ink extraction. Since this disallows a rapid increase of the negative pressure, characteristics as shown in FIG. 9 are obtained.

Since flat sheet members are expanded, variations frequently occur in the expanded shape of the sheet members that form the outline of an ink tank. Since flat sheets 311 are welded to a frame 318 and expanded as shown in FIG. 8, a great number of wrinkles are formed on sheet surfaces that are not regulated by springs and planar members. Since such wrinkles are irregular and non-uniform, the tension in such regions results in variations of stress, and a predetermined negative pressure will not be generated without extracting a great amount of ink. The ink container has low reproducibility of deformation, and its characteristics therefore vary significantly. Variations of characteristics can be also caused by variations of the amount of ink held at the regions of wrinkles on the sheet members and deformation of the regions of wrinkles as a result of ink extraction.

(Manufacturing Method of Ink Container)

There will be described the ink container of the present embodiment and, specifically, the method of manufacture in which movable members constituted by sheet members are formed into a convex configuration and in which the same is fixed to a frame.

Figure 10:
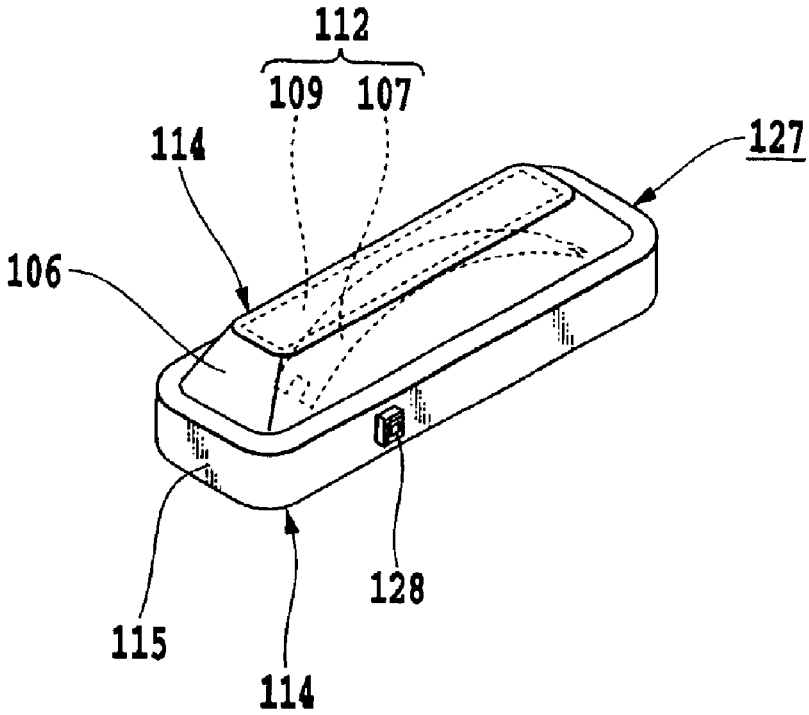
FIG. 10 is a perspective view of an ink tank according to another embodiment of the invention.

FIG. 10 is a perspective view of an ink tank 127 manufactured through steps as described below, the tank having an enclosed structure in which top and bottom spring/sheet units 114 are mounted to openings at the top and bottom of a square frame 115. As will be described later, the spring/sheet unit 114 is constituted by a spring unit 112 including a spring 107 and a pressure plate 109 and a flexible tank sheet (flexible member) 106. The frame 115 is formed with an ink supply port 128 for supplying an ink to a recording head.

FIGS. 11A to 15B illustrate a method of manufacturing such an ink tank 127.

Figure 11A:
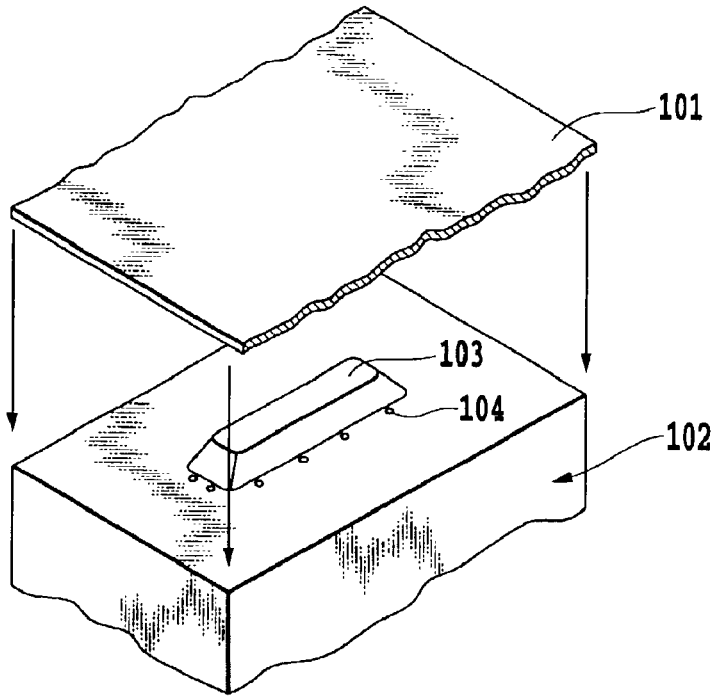
FIGS. 11A, 11B, and 11C are illustrations of steps of forming a tank sheet of the ink tank shown in FIG. 10.
Figure 11B:
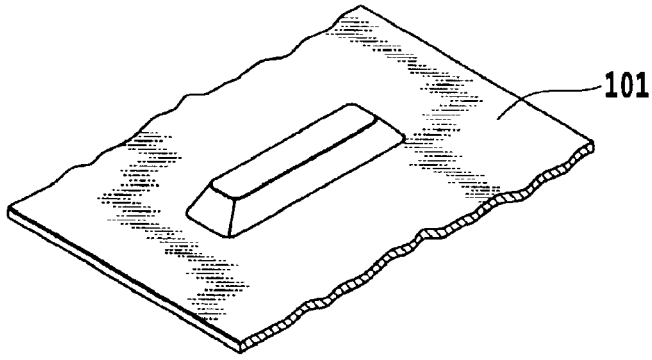
Figure 11C:
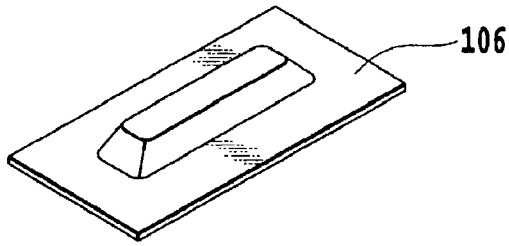

First, FIGS. 11A, 11B, and 11C are illustrations of steps of forming the flexible tank sheet 106 with a convex shape.

A sheet material 101 for forming the tank sheet 106 is formed from a raw material into a sheet having a large size, and the sheet material 101 is an important factor of the performance of the ink tank. The sheet material 101 has low permeability against gases and ink components, flexibility, and durability against repeated deformation. Such preferable materials include PP, PE, PVDC, EVOH, nylon, and composite materials with deposited aluminum, silica or the like. It is also possible to use such materials by laminating them. In particular, excellent ink tank performance can be achieved by laminating PP or PE that has high chemical resistance and PVDC, EVOH that exhibits high performance in blocking gases and vapors. The thickness of such a sheet material 101 is preferably in the range from about 10 $\mu$m to 100 $\mu$m taking softness and durability into consideration.

As shown in FIG. 11A, such a sheet material 101 is formed into a convex shape using a forming die 102 having a convex portion 103, a vacuum hole 104, and a temperature adjusting mechanism (not shown). The sheet material 101 is absorbed by the vacuum hole 104 and formed into a convex shape that is compliant with the convex portion 103 by heat from the forming die 102. After being formed into the convex shape as shown in FIG. 11B, the sheet material 101 is cut into a tank sheet 106 having a predetermined size as shown in FIG. 11C. The size is only required to be suitable for manufacturing apparatus at subsequent steps and may be set in accordance with the volume of the ink tank 127 for containing ink.

Figure 12A:
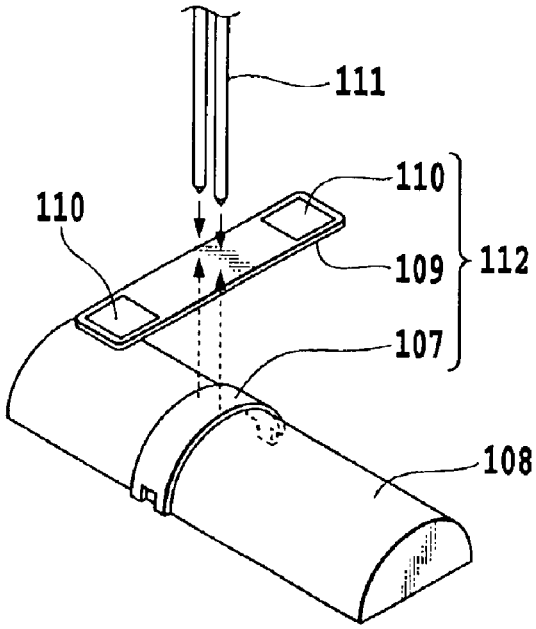
FIG. 12A is an illustration of a step of manufacturing a spring unit of the ink tank in FIG. 10.

FIG. 12A is an illustration of a step of manufacturing the spring unit 112 used for generating a negative pressure in the ink tank 127. A spring 107 that is formed in a semicircular configuration in advance is mounted on a spring receiving jig 108, and a pressure plate 109 is attached to the same from above through spot welding using a welding electrode 111. A thermal adhesive 110 is applied to the pressure plate 109. A spring unit 112 is constituted by the spring 107 and the pressure plate 109.

Figure 12B:
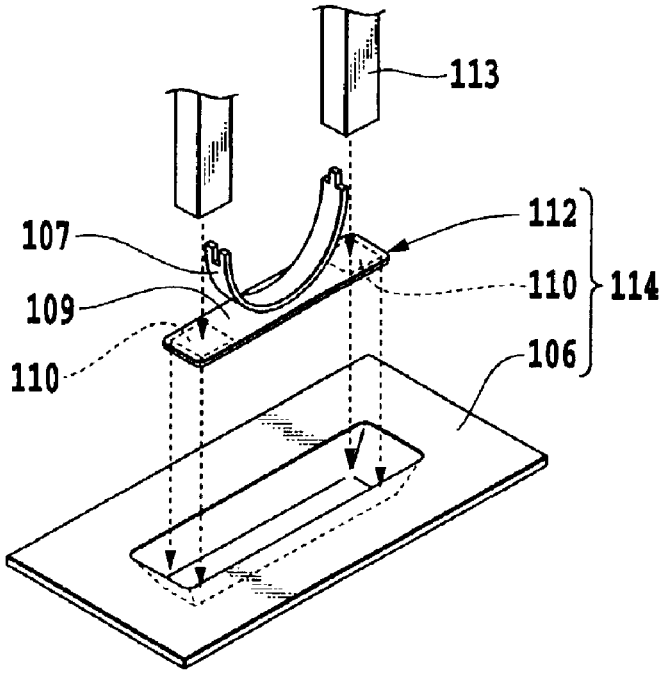
FIG. 12B is an illustration of a step of manufacturing a spring/sheet unit of the ink tank in FIG. 10.

FIG. 12B is an illustration of a step of mounting a spring unit 112 to the tank sheet 106. The spring unit 112 is positioned on an inner surface of the tank sheet 106 placed on a receiving jig (not shown). The thermal adhesive 110 is heated using a heat head 113 to bond the spring unit 112 and the tank sheet 106 to form a spring/sheet unit 114.

Figure 13A:
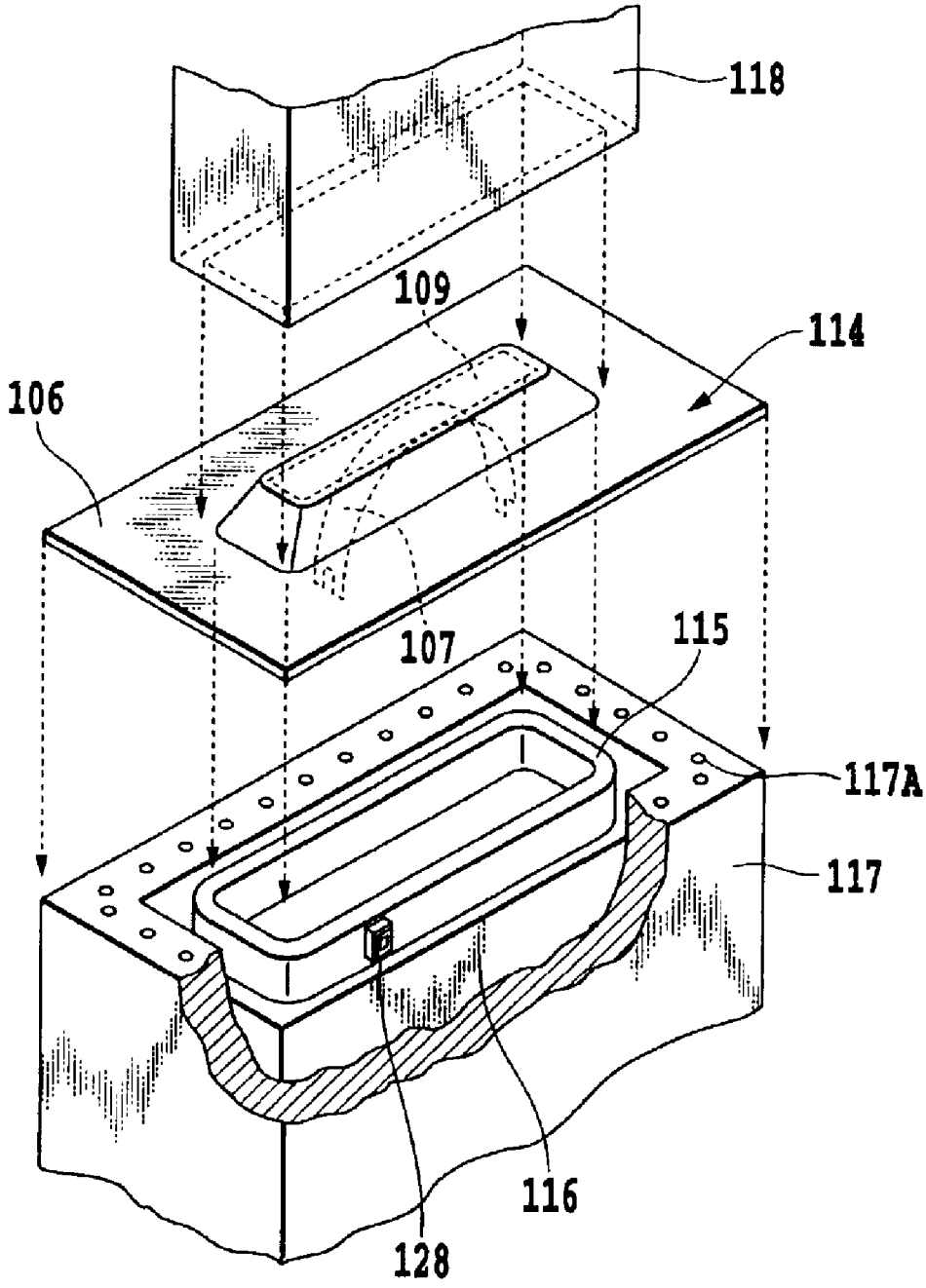
FIGS. 13A and 13B illustrate steps of manufacturing a spring/sheet/frame unit of the ink tank in FIG. 10.

FIG. 13A is an illustration of a step of welding the spring/sheet unit 114 to the frame 115. The frame 115 is secured to a frame receiving jig 116. After the flame 115 is positioned and placed on the jig 116, a sheet absorbing jig 117 surrounding the frame 115 absorbs the spring/sheet unit 114 to a vacuum hole 117A to hold the unit 114 and the frame 115 without relative misalignment. Thereafter, a heat head 118 is used to thermally weld annular joint surfaces of a top side circumferential edge of the frame 115 and a circumferential edge of the tank sheet 106 of the spring/sheet unit 114 in the figure. Since the sheet absorbing jig 117 sets the top circumferential edge of the frame 115 in FIG. 11A and the circumferential edge of the tank sheet 106 of the spring/sheet unit 114 in a uniform face-to-face relationship, the bonding surfaces are quite uniformly thermally welded and sealed. Therefore, the sheet absorbing jig 117 is important for thermal welding in order to provide uniform sealing.

Figure 13B:
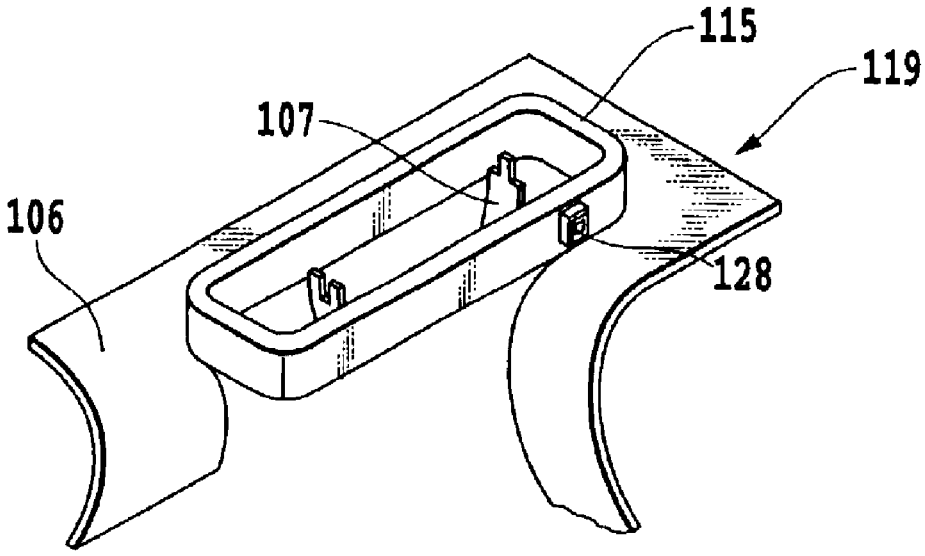

FIG. 13B is an illustration of a step of cutting off a part of the tank sheet 106 protruding from the frame 115 with a cutter (not shown). A spring/sheet/frame unit 119 is completed by cutting off the part of the tank sheet 106 protruding from the frame 115.

Figure 14:
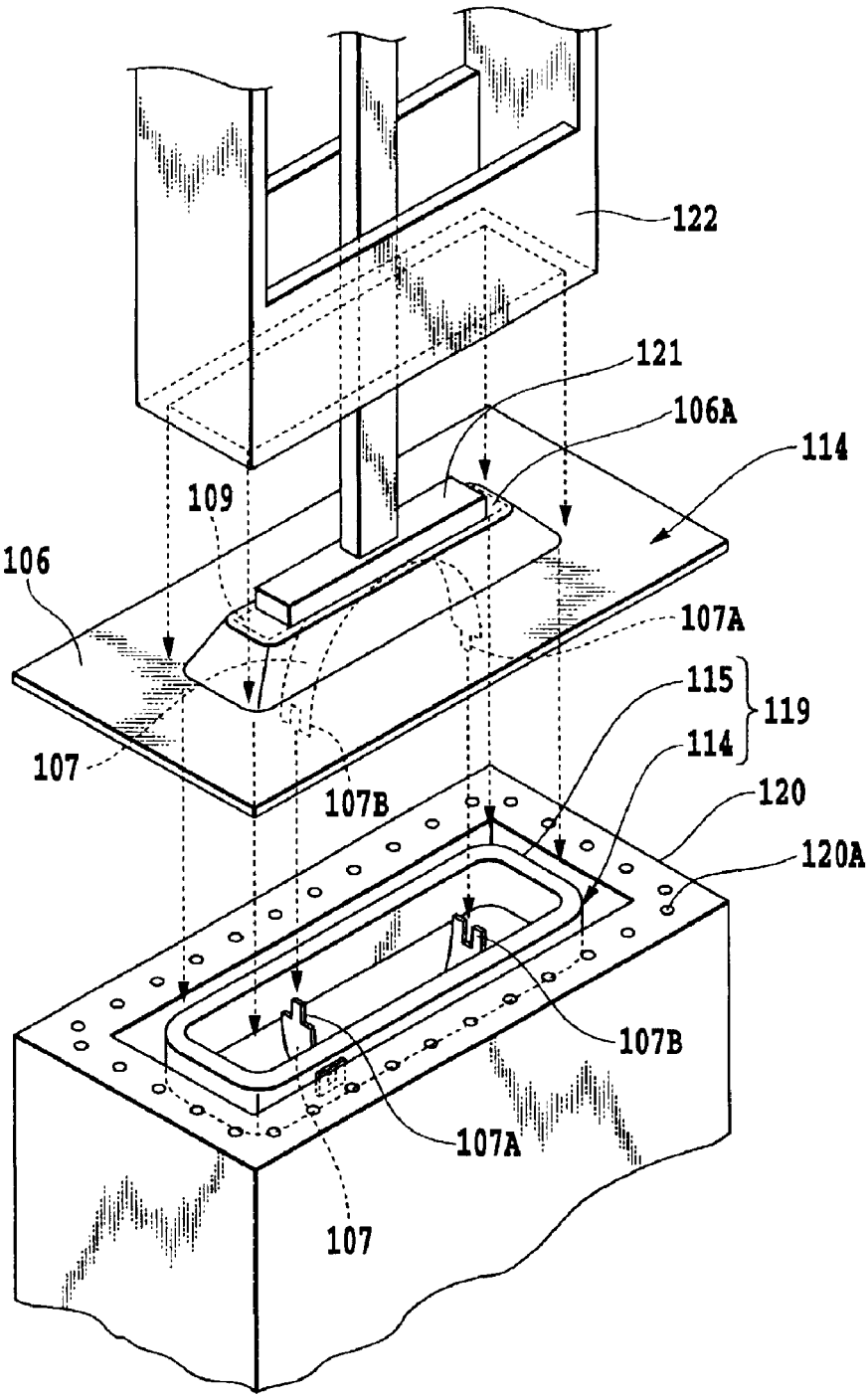
FIG. 14 is an illustration of a step of combining the spring/sheet unit and the spring/sheet/frame unit of the ink tank in FIG. 10.
Figure 15A:
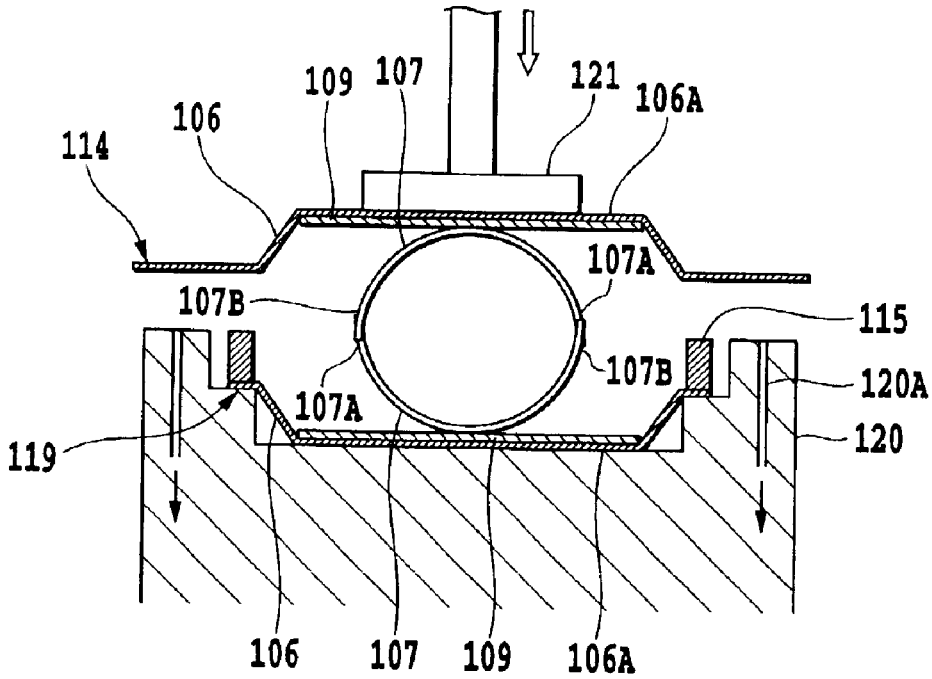
FIGS. 15A and 15B are sectional views of major parts at the combining step in FIG. 14.
Figure 15B:
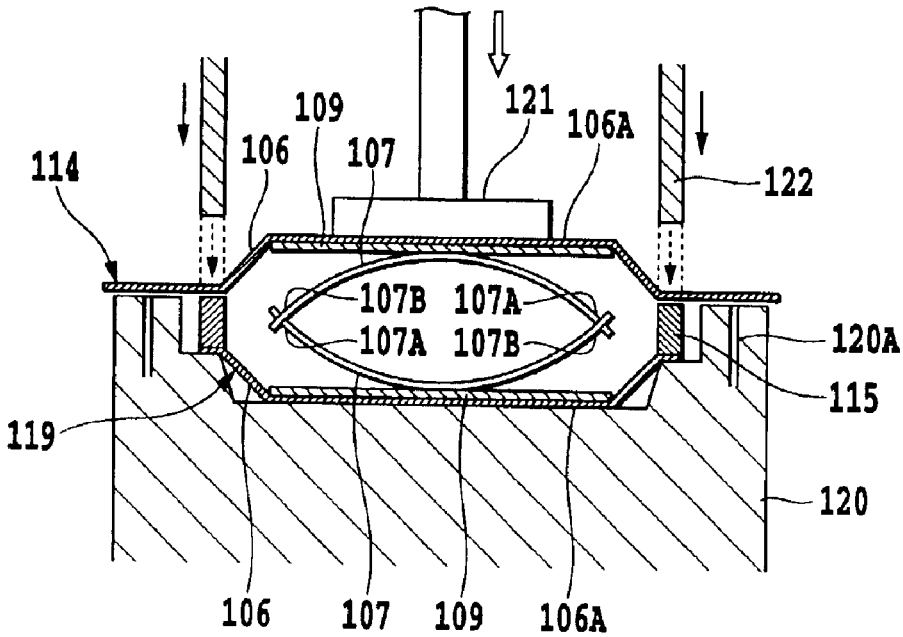

FIG. 14, FIG. 15A, and FIG. 15B are illustrations of steps of thermally welding another spring/sheet unit 114 fabricated through the above-described steps to such a spring/sheet/frame unit 119.

As shown in FIG. 14, the spring/sheet/frame unit 119 is mounted on a receiving jig (not shown), and the periphery of the spring/sheet/frame unit 119 is surrounded by an absorbing jig 120 whose position is defined relative to the receiving jig. The receiving jig is in surface contact with an outer planar section 106A of the tank sheet 106 of the spring/sheet/frame unit 119 to hold the planar section 106A as shown in FIGS. 15A and 15B. The other spring/sheet unit 114 is absorbed and held by a holding jig 121 at an outer planar section 106A of the tank 106 thereof, and the holding jig 121 is lowered to fit ends 107A and 107B of the spring 107 of the spring/sheet unit 114 and ends 107A and 107B of the spring 107 of the spring/sheet/frame unit 119 substantially simultaneously. The ends 107A of the springs 107 have a convex shape, and the other ends 107B have a concave shape, which causes them to fit each other respectively as a self-alignment basis. A single spring member is formed by combining those springs 107 as a pair of spring member forming bodies.

The holding jig 121 is further lowered to compress the pair of springs 107 as shown in FIG. 15A. In doing so, the holding jig 121 widely presses the top planar section 106A of the spring/sheet unit 114 in FIG. 14, i.e., a top flat region of the tank sheet 106 that is formed in a convex configuration. As a result, the position of the planar section 106A of the tank sheet 106 is regulated, and the spring/sheet unit 114 approaches the unit 119 and the jig 120 located below the same while being kept in parallel with them. Therefore, as shown in FIG. 15B, the circumferential edge of the tank sheet 106 of the spring sheet unit 114 is absorbed and held at the vacuum hole 120A in contact with a surface of the absorbing jig 120, and it is also put in a uniform face-to-face relationship with the welding surface (the top joint surface in the same figure) of the frame 115. In this state, annular joint surfaces of the top circumferential edge of the frame 115 of the spring/sheet/frame unit 119 and the tank sheet 106 of the spring/sheet unit 114 are thermally welded to each other with a heat head 122.

By compressing the pair of springs 107 while thus maintaining parallelism between the planar section 106A of the tank sheet 106 of the upper unit 114 and the planar section 106A of the tank sheet 106 of the lower unit 119, ink tanks 127 having high parallelism between the planar sections 106A of the pair of tank sheets 106 thereof can be produced on a mass production basis with stability. Since the pair of springs 107 are symmetrically and uniformly compressed and deformed in FIGS. 15A and 15B, there will be no force that can incline the spring/sheet unit 114, which makes it possible to produce ink tanks 127 having high parallelism between the planar sections 106A of the pair of tank sheets 106 thereof with higher stability. Further, since the pair of springs 107 are symmetrically and uniformly compressed and deformed in FIGS. 15A and 15B, the interval between the planar sections 106A of the pair of tank sheets 106 in a face-to-face relationship changes with higher parallelism maintained, which consequently makes it possible to supply ink with stability. Further, the ink tank 127 has high sealing property, pressure resistance, and durability because no force acts to incline the planar section 106A of the flexible tank sheet 106.

Thereafter, the part of the tank sheet 106 protruding from the frame 115 is cut off to complete the ink tank 127 as shown in FIG. 10. The interior of the ink tank 127 has an enclosed structure that is in communication with the outside only through the ink supply port 128.

(Example of Structure of Inkjet Printing Apparatus)

Figure 16:
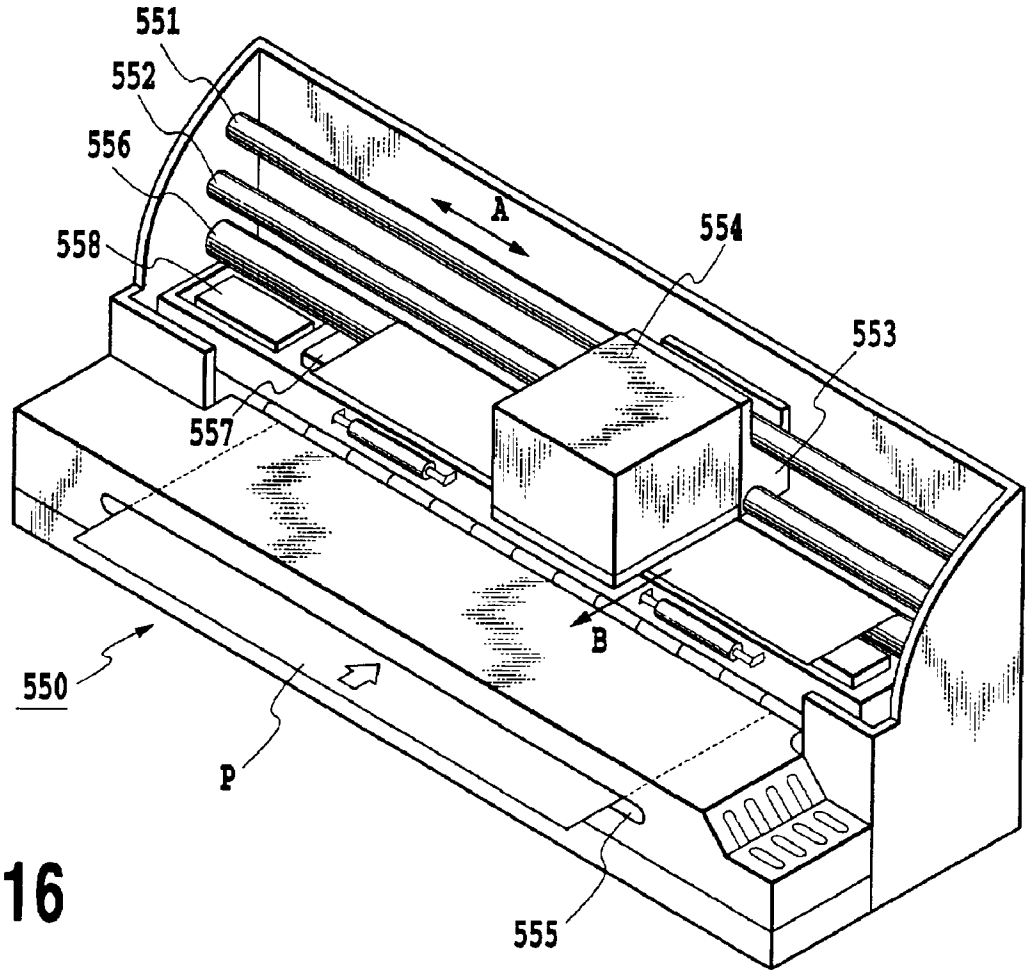
FIG. 16 is a perspective view of an example of an inkjet recording apparatus utilizing an ink container according to the above embodiments and a recording head.

FIG. 16 is a perspective view showing an example of a configuration of an inkjet recording apparatus utilizing an ink container (ink tanks) or inkjet cartridge in each of the above embodiments. Such a recording apparatus employs the continuous supply method used in so-called serial type inkjet printing apparatus in which a printing head is scanned back and forth in a predetermined direction relative to a printing medium and in which the printing medium is transported in a direction substantially orthogonal to the above direction, for forming an image. It is an example of printers called on-carriage type in which ink is supplied by mounting ink tanks integrally or detachably to a printing head that is loaded on a carriage and is moved back and forth (main scanning).

In the recording apparatus 550 of the present embodiment, a carriage 553 is guided by guide shafts 551 and 552 such that it can be moved in main scanning directions indicated by the arrow A. The carriage 553 is moved back and forth in the main scanning direction by a carriage motor and a driving force transmission mechanism such as a belt for transmitting a driving force of the same motor. The carriage 553 carries an inkjet recording head (not shown in FIG. 16) and an ink tank (ink container) 510 for supplying ink to the inkjet recording head. The ink tank 510 has a structure similar to that of the embodiment shown in FIG. 1 or FIG. 10, and it may form an inkjet cartridge in combination with the inkjet recording head. Paper P as a recording medium is inserted into an insertion hole 555 provided at a forward end of the apparatus and is then transported in a sub-scanning direction indicated by the arrow B by a feed roller 556 after its transporting direction is inverted. The recording apparatus 550 sequentially forms images on the paper P by repeating a recording operation for ejecting ink toward a printing area on the paper P while moving the recording head in the main scanning direction and a transporting operation for transporting the paper P in the sub-scanning direction a distance equivalent to a recording width.

The inkjet recording head may utilize thermal energy generated by an electrothermal transducer element as energy for ejecting ink. In this case, film boiling of ink is caused by the heat generated by the electrothermal transducer element, and ink is ejected from an ink ejection port by foaming energy generated at that time. The method of ejecting ink from the inkjet recording head is not limited to such a method utilizing an electrothermal transducer element and, for example, a method may be employed in which ink is ejected utilizing a piezoelectric element.

At the left end of the moving range of the carriage 553 in FIG. 16, there is provided a recovery system unit (recovery process unit) 558 that faces a surface of the inkjet printing head carried by the carriage 553 where an ink ejecting portion are formed. The recovery system unit 558 is equipped with a cap capable of capping the ink ejection portion of the recording head and a suction pump capable of introducing a negative pressure into the cap, and the unit can performs recovery process (also referred to as "suction recovery process") for maintaining a preferable ink ejecting condition of the inkjet recording head by introducing a negative pressure in the cap covering the ink ejection portion to absorb and discharge ink through the ink ejection ports.

In the recording apparatus of the present embodiment, ink is supplied to the inkjet recording head from the ink tank 510 carried by the carriage 553 along with the inkjet recording head.

(Functions of Spring Unit)

At the above manufacturing steps as described with reference to FIGS. 6A, 7, and 8 in particular, the ink tank sheets 106 are formed with a convex feature for maintaining a predetermined ink capacity in advance. Therefore, the capacity is stable even if the ink tanks have a small capacity, and the sheet members can be provided with predetermined rigidity. This makes it possible to improve durability of the sheets during use dramatically. That is, there is no wrinkle on the sheets which may cause sheet defects which may lead to leakage, evaporation and mixing of inks. Further, the pressure plates 109 of the spring units 112 are bonded to the ink tank sheets, the shape of the ink tank sheets 106 is maintained by the spring force after they are welded to the frames 115.

A description will follow on advantages of the fact that the ink tanks of the present embodiment has the convex feature and advantages or functions of the above-described spring units 112 that are associated with deformation of the tanks as a result of reductions in ink amounts.

Figure 17A:
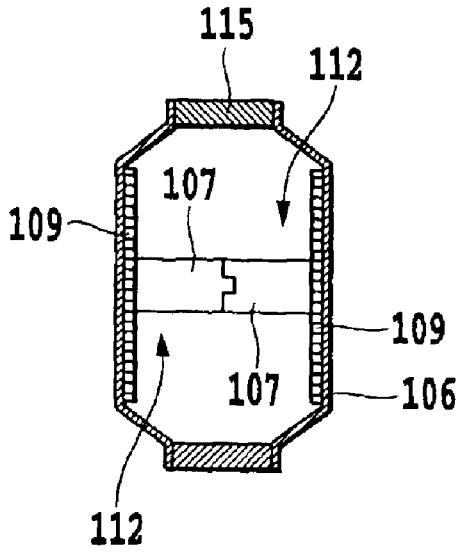
FIGS. 17A and 17B are transverse and longitudinal sectional views of the ink tank, respectively, showing the spring unit in particular.
Figure 17B:
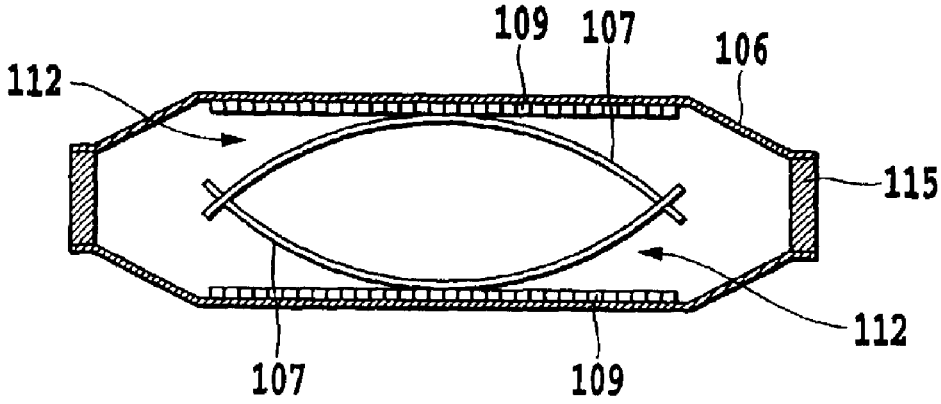

A spring unit 112 is constituted by a spring 107 and a pressure plate 109. FIGS. 17A and 17B are transverse and longitudinal sectional views, respectively, of spring units 112 showing a positional relationship between the units and sheets 106.

As shown in those figures, the pressure plate 109 as a whole is connected to a surface at the top section of the convex feature, which always keeps the top section in a planar configuration to provide this section with rigidity higher than that of other sections of the sheet 6.

FIGS. 18A to 18D show a process of deformation of an ink tank of the present embodiment as a result of a reduction in the amount of ink. FIGS. 19A to 19D show a process of deformation of an ink tank which has a convex shape but does not use spring units as a result of a reduction in the amount of ink, as a comparative example.

Figure 19A:
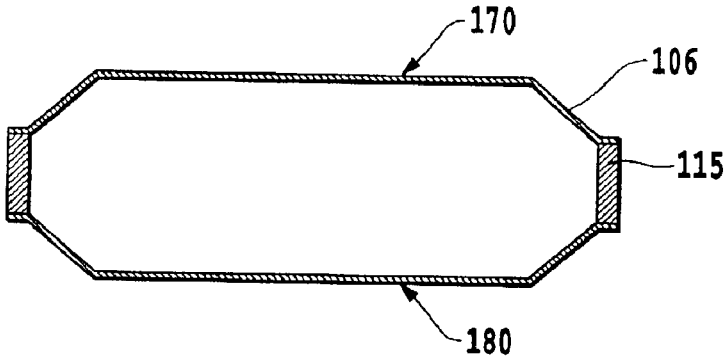
FIGS. 19A to 19D relate to a comparative example an ink tank and show deformation thereof as a result of ink consumption similarly to FIGS. 18A to 18D.
Figure 19B:
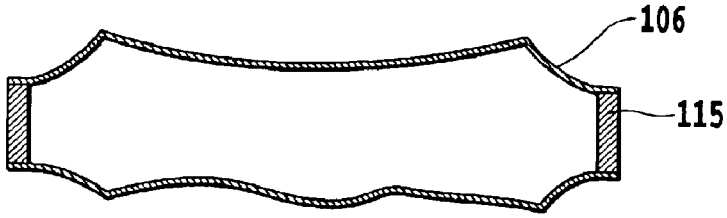

In the comparative example shown in FIGS. 19A to 19D, when ink in the ink tank is consumed, deformation of the ink tank that is constituted by sheets 106 and a frame 115 as shown in FIG. 19A starts at planar sections 170 and 180 which are sections of the sheets 106 that have a greatest surface area. At this time, the planar sections 170 and 180 may be deformed into different shapes as shown in FIG. 19B, and they may be deformed with a time difference.

Figure 19C:
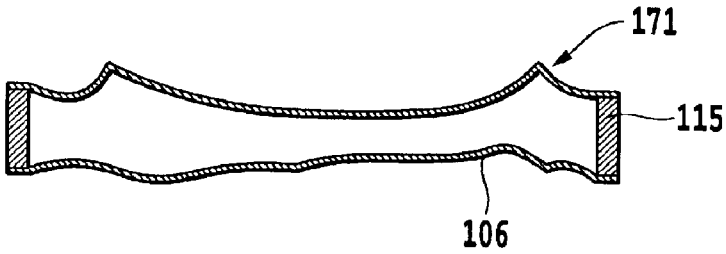
Figure 19D:
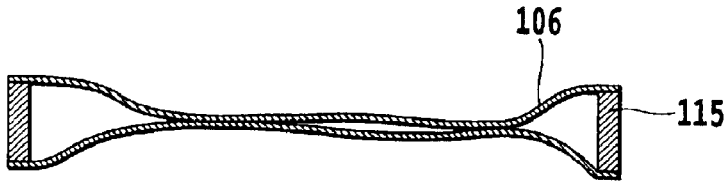

When the amount of ink in the ink tank is further reduced, ridges 171 of the convex features of the sheets 106 are left undeformed because of their rigidity higher than that of the planar sections of the sheets 106 as shown in FIG. 19C, and the ridges 171 finally fall down as shown in FIG. 19D to collapse the ink tank completely, in which state the planar sections 170 and 180 are in contact with each other.

In the case of the ink tank of the comparative example constituted by only sheets 106 and a frame 115, it is relatively low in stability of its shape when the pressure in the tank repeatedly changes as a result of ink consumption or replenishment. It is also vulnerable to the influence of the ambient temperature and the material and the forming process of the sheet.

Figure 18A:
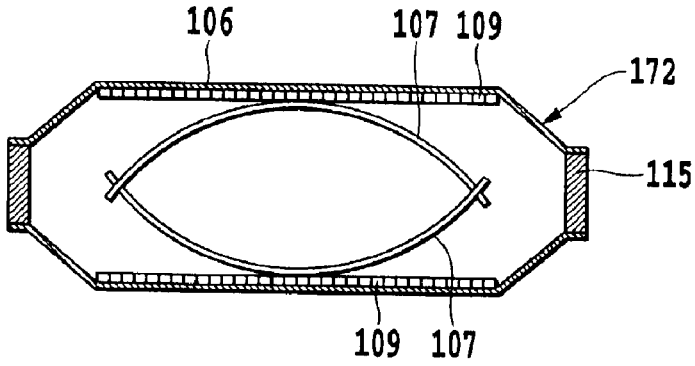
FIGS. 18A to 18D show deformation of the ink tank as a result of ink consumption.

As shown in FIG. 18A, the ink tank of the present embodiment having the spring units 112 has a shape similar to that of the sheet without springs as a comparative example (FIG. 17A) in its initial state. When the amount of ink in the ink tank is reduced, movable sections 172 of the sheets 106 first cave in as shown in FIG. 18B because the deformation of the same is not controlled by the spring units 112 as a whole through the pressure plates 109 of the spring units 112, and the springs 107 of the spring units 112 gradually contract accordingly.

Figure 18B:
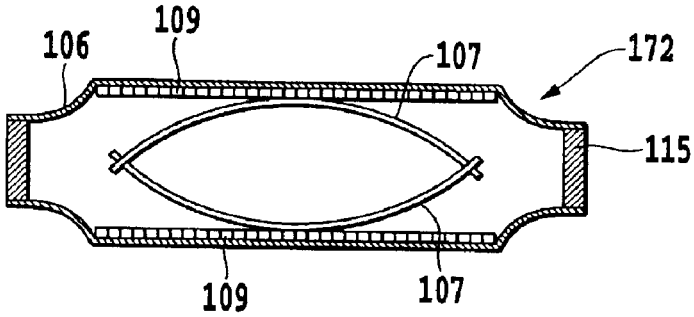
Figure 18C:
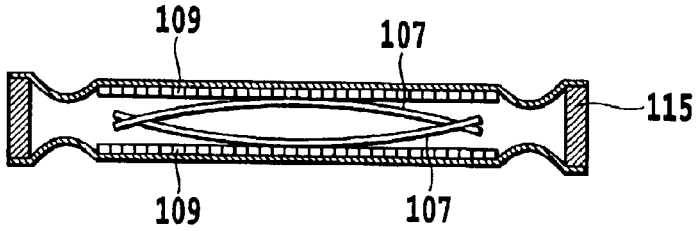
Figure 18D:
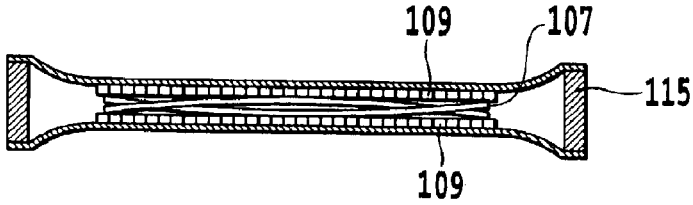

The sheets 106 are displaced in parallel with each other as shown in FIGS. 18B and 18C because the pressure plates 109 of the spring units 112 are bonded to the sheets 106 to be collapsed completely as shown in FIG. 18D if the sheets 106 are deformed to the limit. Herewith, in the state that the pair of opposed pressure plates 109 which supports planer portions of the pair of opposed sheets 106 is brought to a state of maximum displacement, as apparently shown from FIG. 19D, there is a little dead space within the ink tank. That is, the ink tank has a good capacity efficiency.

Referring to ridges that cause an increase in the negative pressure as a result of deformation in the case of the sheets without springs, since the deformation of the sheets 106 themselves is regulated by the spring units 112, ridges will change in accordance with gentle changes of the spring units 112, which eliminates great fluctuations in the negative pressure.

Thus, the ink tank of the present embodiment is formed in a convex shape to maintain a predetermined capacity even if relatively narrow space for installation can be obtained due to restrictions resulting from a configuration of the printing apparatus, and the convex shape makes it possible to improve ease of assembly as described above.

(Control over the Rigidity of Ridges of Convex-Shaped Sheets)

Other embodiments of the invention will now be described which relates to control over the rigidity of such ridges in particular.

FIGS. 20A, 20B, 21A, 21B, 22A, and 22B illustrate three embodiments of sheet configurations for moderating the rigidity of a convex feature, especially in ridge sections, of a sheet 106 that is deformed according to changes in the amount of ink in the ink tank.

Figure 20A:
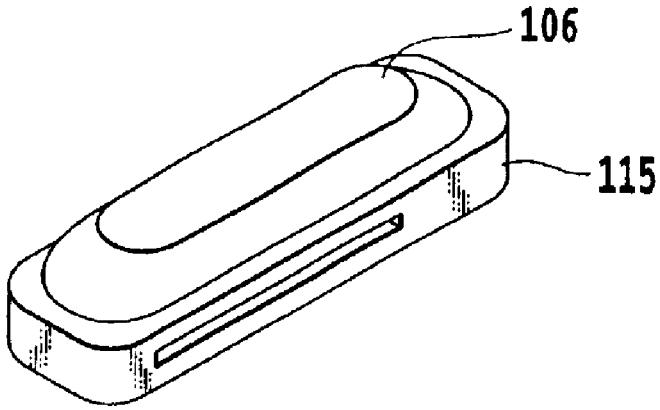
FIGS. 20A and 20B are perspective and longitudinal sectional views, respectively, of another embodiment of the shape of a side portion of a convex feature of the sheet that constitutes the ink tank.
Figure 20B:
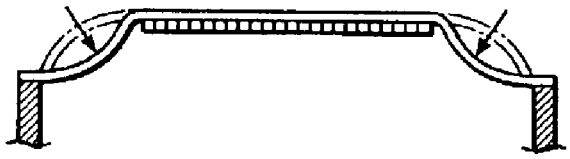

FIGS. 20A and 20B are a perspective view and a longitudinal sectional view, respectively, of a side section of a convex feature of a sheet 106 between a top section (planar section) and a frame 115, the side section being a curved surface. In this case, since the side section has a curved configuration, the sheet can be deformed with a force smaller than that in the case of a linear side section, as shown in FIG. 20B.

Figure 21A:
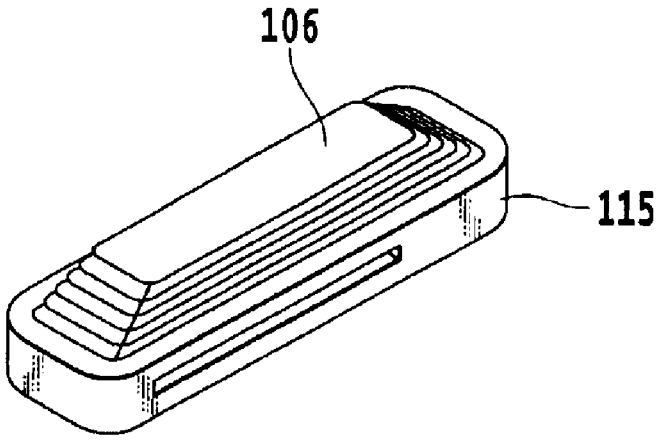
FIGS. 21A and 21B are perspective and longitudinal sectional views, respectively, of still another embodiment of the shape of the side portion of the convex feature of the sheet that constitutes the ink tank.
Figure 21B:
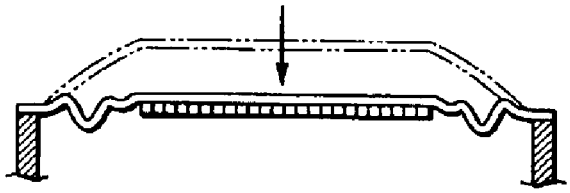

FIGS. 21A and 21B show an example of a sheet configuration in which the side section is in the form of steps. In this case, the sheet 106 can be easily deformed in the vertical direction, and slacks of the sheet 106 as a result of deformation can be absorbed by the step-like feature especially when the sheet 106 falls down below the plane of welding of the same to the frame 115 as a result of deformation (FIG. 21B), which allows deformation to occur more easily.

Figure 22A:
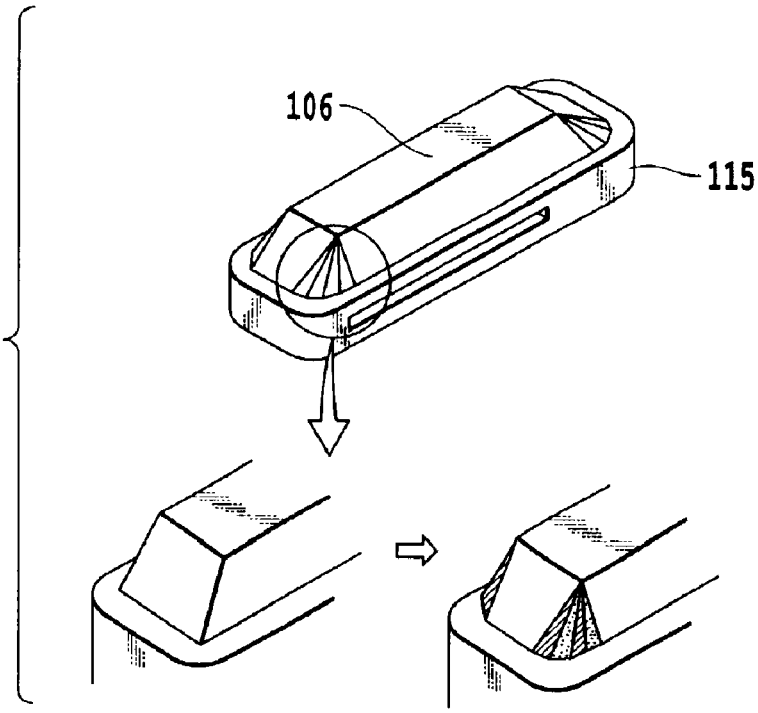
FIGS. 22A and 22B are perspective and longitudinal sectional views, respectively, of still another embodiment of the shape of the side portion of the convex feature of the sheet that constitutes the ink tank.
Figure 22B:
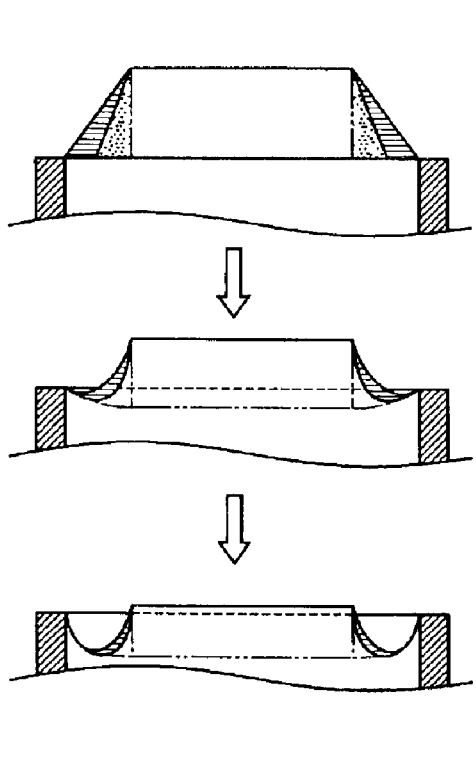

FIGS. 22A and 22B show an example in which the inclination of the side section of the convex feature is increased and in which the side section is formed by a multiplicity of planes. By forming the side sections with plural planes that are deformed by a smaller force compared to two planes that define a single ridge, the force required to deform the sheet as a whole can be made smaller, thereby allowing the side section of the convex feature to be easily deformed. More stable negative pressure characteristics and ink input/output characteristics can be obtained by forming the ridge configuration as described above.

(Configuration and Operation of Springs)

Figure 23A:
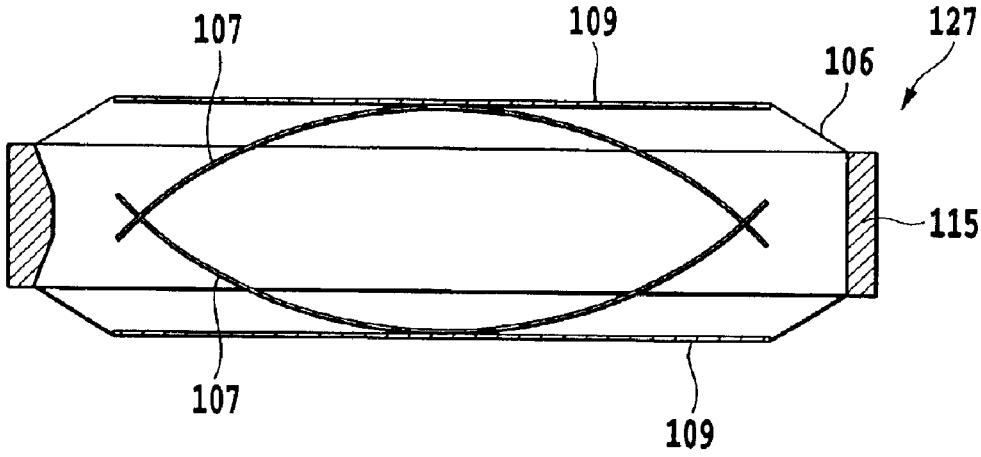
FIGS. 23A and 23B are schematic sectional views of the ink tank in FIG. 10.
Figure 23B:
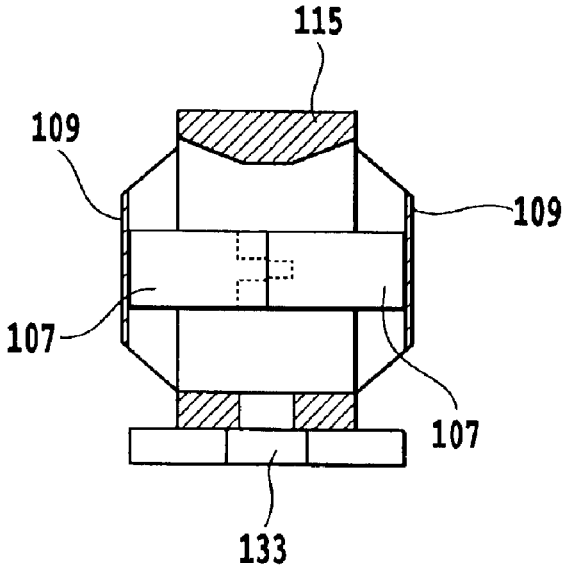
Figure 24A:
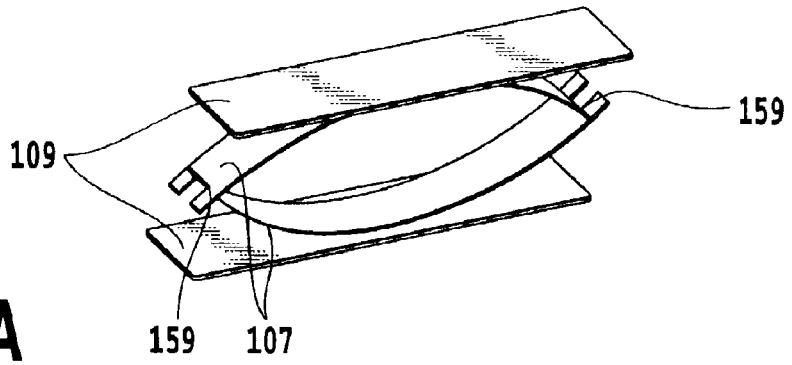
FIGS. 24A to 24C are schematic perspective views showing phases of deformation of a pair of springs in the ink tank.
Figure 24B:
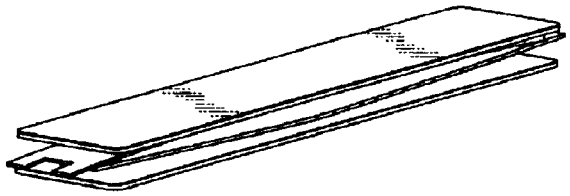
Figure 24C:
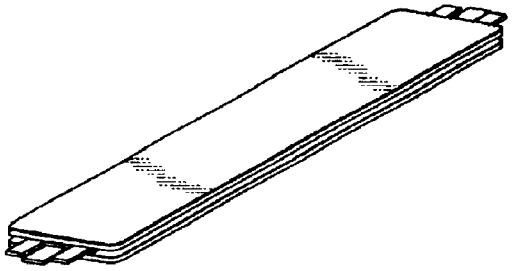

FIGS. 23A and 23B are schematic sectional views of the ink tank shown in FIG. 10. FIGS. 24A to 24C are schematic perspective views of the pair of spring units 112 according to the present embodiment showing phases of deformation of the same.

In FIGS. 23A and 23B, one of the springs 107 is coupled to the pressure plate 109 through spot welding and bonded and secured to the tank sheet 106 through the pressure plate 109, and the tank sheet 106 is welded to the frame 115. The opposite side is similarly configured in a symmetrical relationship. The springs 107 exert a force in the direction of expanding the tank sheets 106 outwardly to generate a negative pressure in the ink tank. In the present embodiment, the pair of springs 107 serves as a negative pressure generating member in combination, and the springs 107 are engaged with each other at engaging sections. Incidentally, reference numeral 133 denotes a head chip for constituting a recording head.

As shown in FIGS. 24A to 24C, the pair of spring units 112 is deformable to enter the states shown in FIGS. 24A, 24B, and 24C sequentially as the amount of ink in the ink tank is reduced. In the cases where the ink is charged by an intermittent supplying system described in the following embodiment, it returns from the state in FIG. 24C to the state in FIG. 24B and then to the state in FIG. 24A. Thus, the springs are repeatedly deformed in accordance with a repetition of the ink discharging and the ink charging.

Figure 25A:
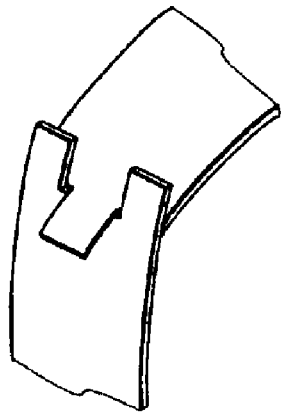
FIGS. 25A and 25B are enlarged views of engaging sections of the pair of springs associated with the states shown in FIGS. 24A and 24B, respectively.
Figure 25B:
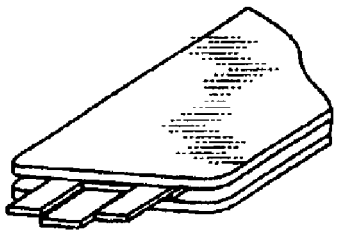

FIGS. 25A and 25B are enlarged views of the engaging section 159 of the pair of springs 107 that are associated with the states in FIGS. 20A and 20B respectively. In either of the states, the engaging sections are fitted to each other at both ends thereof using concave and convex configurations of each other. When at least one of the engaging sections of the negative pressure generating member is integrally formed by bending a single component like the elliptic-like spring disclosed in Japanese Patent Application Laid-Open No. 6-226993 (1994), the bent section may be broken due to fatigue during repeated deforming operations. In the present embodiment, the negative pressure generating member has a two-part configuration formed by combining a pair of springs, and the engaging sections between the two parts are formed by mating concave and convex features, which makes it possible to disperse stress that occurs at the spring members during deformation and to avoid breakage due to fatigue.

In the present embodiment, the width of the openings of the concave portions is smaller than the width of the protrusions at the convex portions by 0.1 mm or more to allow the engaging sections on both ends to move relative to each other. This configuration allows dispersal of stress as described to take place more efficiently.

In the case of a configuration in which movable sections are symmetrically formed on both sides of an elliptic-like spring, a force to deform the movable sections acts off balance because of the presence of a bent portion, which can make the deformation of the movable sections unstable. Further, variations of the deformation of one of the movable sections can affect the opposite movable section through the semi-elliptic spring, which may incline the pressure plate and tank sheet at the opposite movable section to cause interference with other members. On the contrary, the engaging sections of the present embodiment work under the same conditions on both sides, and the pair of movable sections (the pressure plates 109 and tank sheets 106) is displaced with parallelism substantially maintained between them. Therefore, even if the movable sections are deformed with one of the pressure plates inclined from a balanced state, problems can be avoided because the two members are less limited by each other at the engaging sections. Since this also makes it possible to reduce fluctuations of the pressure in the ink tank effectively, there is a very small possibility that the ejecting performance of the printing head is adversely affected.

Figure 26:
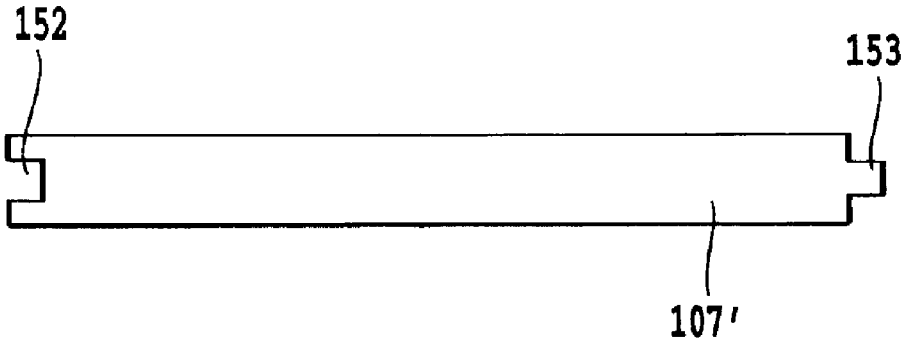
FIG. 26 is a schematic view of a material for forming the springs shown in FIGS. 23A to 25B.

FIG. 26 is a schematic view of a material or piece 107' for a spring 107 of the present embodiment. As apparent from the figure, the spring piece 107' has a concave configuration at one end 152 thereof and a convex configuration at another end 153 thereof. Therefore, what is required is only to prepare one type of spring materials 107', to bend them to form springs 107, and to combine a pair of springs 107, which is advantageous in terms of manufacturing cost.

Figure 27A:
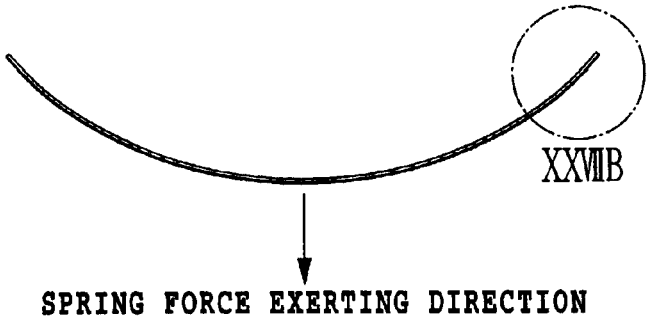
FIGS. 27A to 27C are schematic views for explaining the shape of ends of the springs shown in FIGS. 23A to 25B.
Figure 27B:
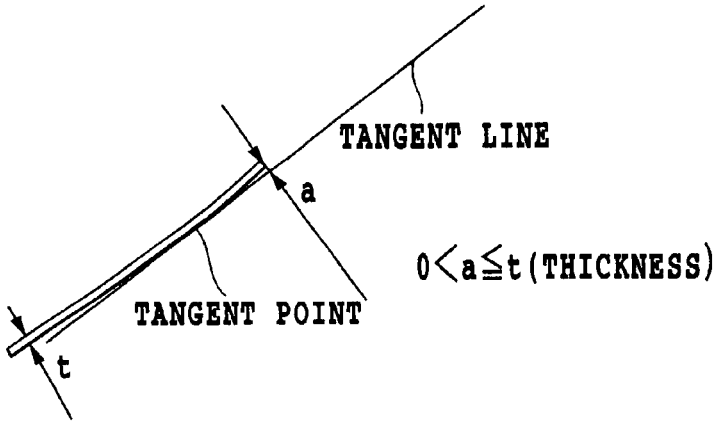
Figure 27C:
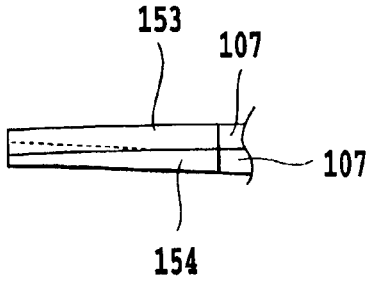

FIGS. 27A to 27C are schematic views for explaining configurations of ends of springs in the present embodiment. FIG. 27A is a schematic side view showing a bent state of a spring 107, and FIG. 27B is a schematic enlarged view of an end of the spring 107 (the portion XXVIIB in FIG. 27A). In the present embodiment, the springs are formed such that a relationship expressed by $0<a\leqq t$ (thickness) is satisfied where 'a' represents the amount of deflection of the end of the concave or convex portion relative to a tangent line in the position of the base of the concave or convex portion on the surface of the spring in the direction in which the spring force is exerted. In such a configuration, even when the pair of springs 107 is completely closed as shown in FIG. 27C, the concave portion 153 and the convex portion 154 overlap with each other, which eliminates the possibility of disengagement of the engaging section.

The configuration of the springs is not limited to the above embodiment, and various configuration my be employed.

Figure 28A:
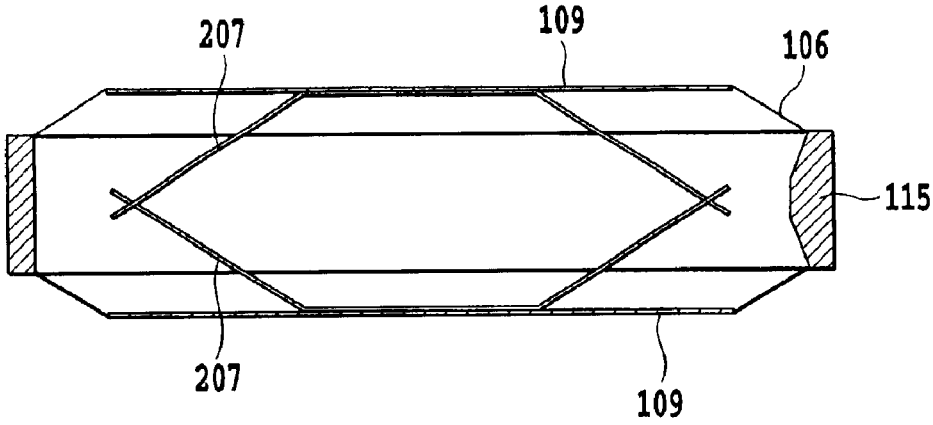
FIGS. 28A and 28B are schematic sectional views of an ink tank according to another embodiment of the invention.
Figure 28B:
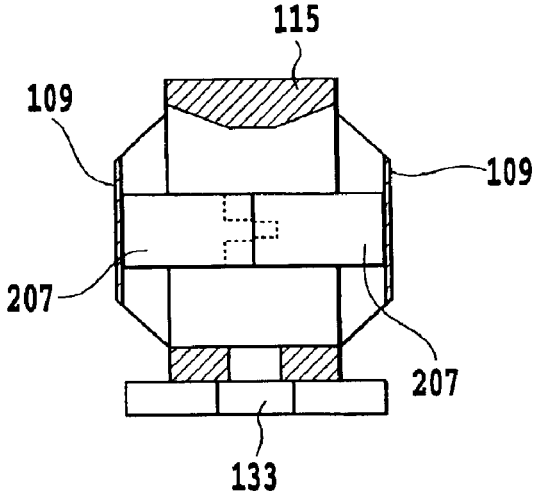
Figure 28C:
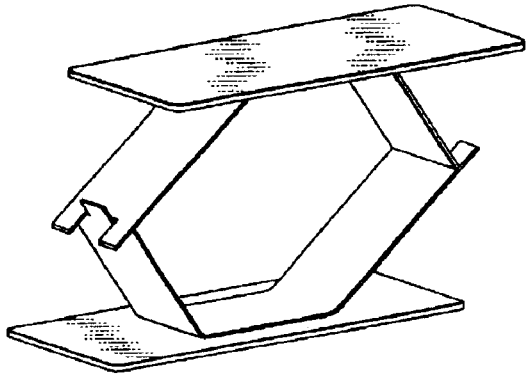
FIG. 28C is a perspective view of a negative pressure generating member.

FIGS. 28A and 28B are schematic sectional view of liquid container according to another embodiment of the invention, and FIG. 24C is a perspective view of a negative pressure generating member. While the above embodiment employs a configuration in which the springs have a curvature throughout the entire length thereof, springs 207 of the present embodiment are formed by a straight line and a bent section. The present embodiment is similar to the above embodiment in that a pair of springs are combined and in the configuration of an engaging section between them.

In the present embodiment, since wide areas can be accommodated for the bonding of the springs 207 to pressure plates 109, bonding accuracy can be improved because of stable bonding between them. Although the durability of the bent sections against repeated deformation is lower than that in the above embodiment, since the bent sections have an internal angle beyond 90 degrees, they have much higher durability compared to that of a spring constituted by a single member which is turned at 180 deg or more in the middle thereof.

Figure 29A:
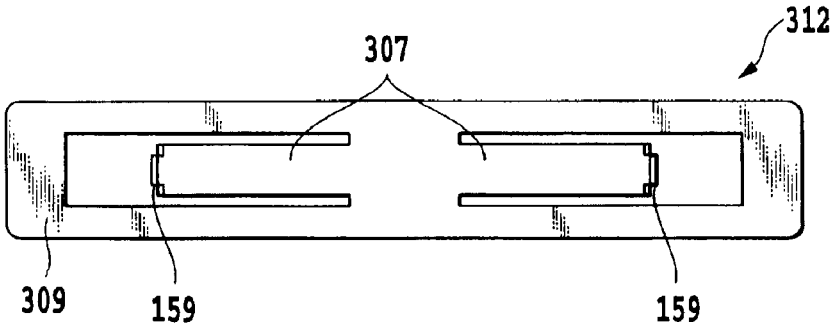
FIGS. 29A, 29B, and 29C are a schematic plan view, side view, and perspective view, respectively, for explaining a spring unit according to still another embodiment of the invention.
Figure 29B:
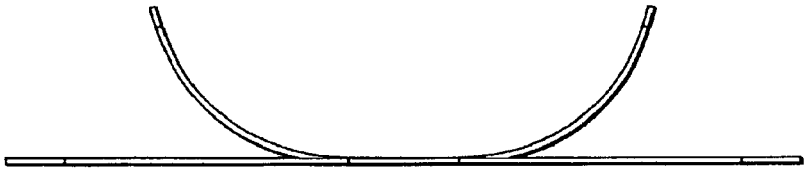
Figure 29C:
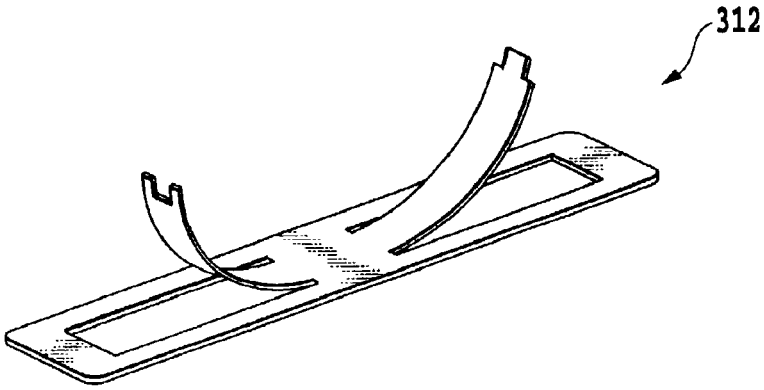

FIGS. 29A, 29B, and 29C are a schematic plan view, side view, and perspective view, respectively, for explaining a spring unit according to still another embodiment of the invention. While a spring unit provided by integrating a pressure plate and a spring that are separate from each other through spot welding has been described above, a spring unit is constituted by a material having integral sections to serve as a pressure plate and a spring in the present embodiment. Such a spring unit 112 can be manufactured through the following steps.

The outlines of sections to serve as springs are formed from a spring unit material that is a sheet of metal using wire cutting or etching, and the sections are bent into spring portions 307. The remaining flat section serves as a pressure plate 309. When the unit may damage a sheet 106 because of flashes or edges present on the surface thereof to be bonded to the sheet 106, the outlines of the spring portions may be punched by performing a press process from the side of the bonding surfaces. Concave and convex configurations of the ends of the springs to serve as engaging sections are similar to those in the above embodiment.

The present embodiment allows a reduction in manufacturing cost because the number of components is reduced and the step of welding a spring and a pressure plate can be deleted from the manufacture of an ink tank. Further, since the spring portions 307 enter in the cut sections of the pressure plate when the spring are completely closed, the spring unit 312 occupies only a volume that is substantially equal to the volume of the material in the ink tank, which allows ink to be contained and used with improved efficiency.

Since the pressure plate is required to have a certain degree of rigidity in order to provide a function of regulating the displacement of a sheet, a desired negative pressure may be generated by forming the spring sections with a cut-out or punch-out when the spring portions that are formed from the same material have a high elastic force.

Instead of a pair of springs 107, a single spring may be provided which has a configuration that is similar to the combination of the two springs. In this case, the single spring may be mounted to one of a pair of tank sheets 106; the tank sheet 106 may then be coupled with a frame 115; and the other tank sheet 106 may be coupled with the frame 115 while compressing the single spring. In doing so, the single spring may be simply sandwiched between the pair of tank sheets 106 instead of mounting it to the other one of the pair of tank sheets 106.

At least either of the pair of tank sheets 106 may be constituted by a flexible member.

(Improvement of Gas Blocking Performance of the Ink Tank)

Now, referring to FIGS. 30 to 36, there follows an explanation of a construction for obtaining an ink tank having a simple structure and keeping a long term gas barrier ability or gas blocking performance. Here is illustrated a structure for improving the gas blocking performance is employed to the ink tank of the intermittent supplying system. As a matter of course, such structure can also be applied to the above-stated ink tank of on-carriage system.

Figure 30:
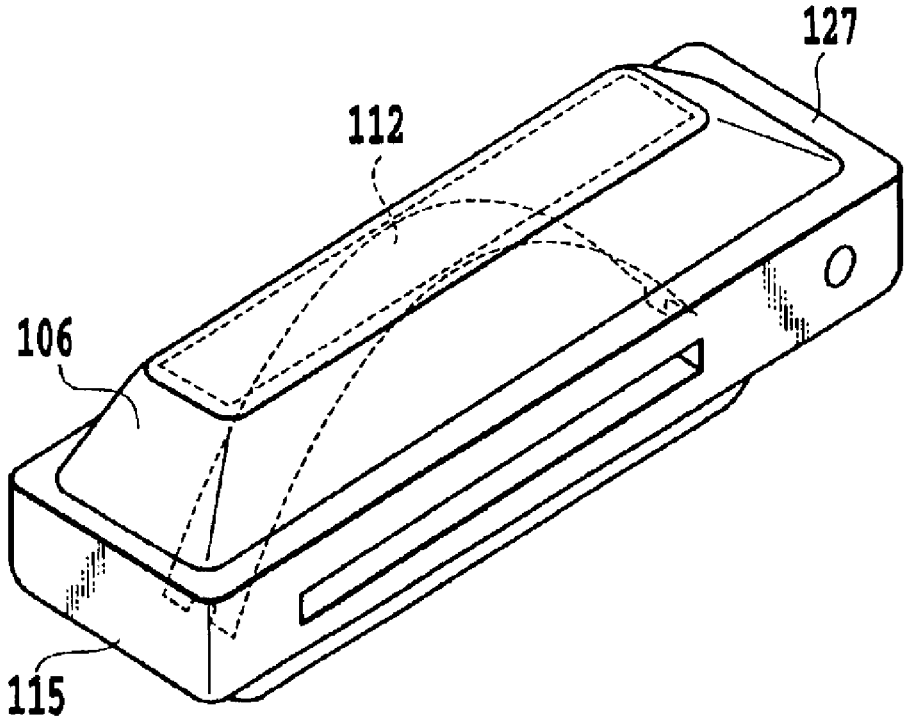
FIG. 30 is a perspective view of an ink tank according to still another embodiment of the invention.

An ink tank 127 shown in FIG. 30 has basically the same structure of the ink tank as illustrated in FIG. 2. Namely, the ink tank 127 is constituted by deformable tank sheets 106, a frame 115, and a spring unit 112. Although polypropylene (PP) is used as the material of the frame 115, this is not limiting the invention. In addition to PP, for example, polyethylene (PE), a material that is a mixture of PP and PE, Noryl (PPO), polysulfone (PSF), acrylic, and polystyrene (PS) may be used as the material of the frame from viewpoints of contact properties against ink, formability of the materials, strength, and ease of assembly.

Figure 31A:
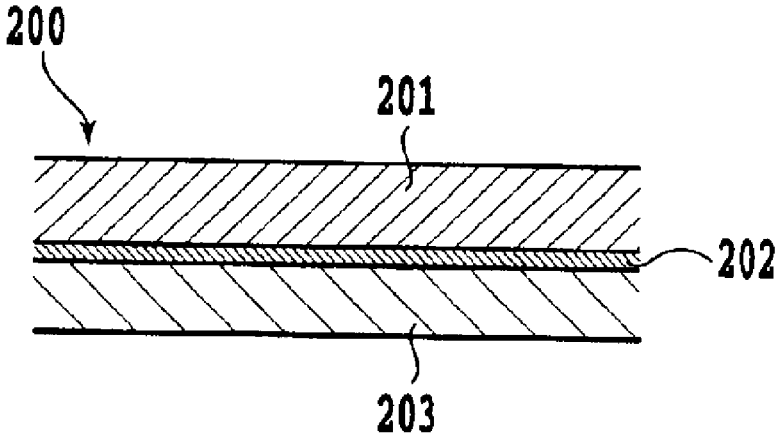
FIGS. 31A and 31B are sectional views of film members having low gas permeability used in an ink tank according to the invention, FIG. 31A showing an example of a multi-layer film member, FIG. 31B showing an example of a single-layer film member.
Figure 31B:
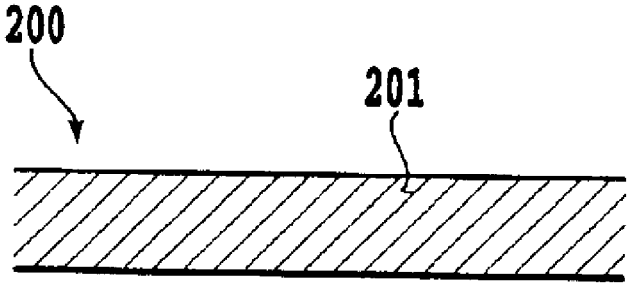

FIGS. 31A and 31B show examples of a film member 200 used for protecting an outer surface of the frame 115 to suppress permeation of gases into the ink tank 127. FIG. 31A is a sectional view of a multi-layer film member, and FIG. 31B is a sectional view of a single-layer film member.

Referring to the configuration of the film member 200, it is constituted by at least one protective layer 201 made of a material having excellent gas blocking performance or low gas permeability, a layer 203 made of the same material or a different material, and a bonding layer 202 for bonding those two layers. FIG. 31A is a sectional view of an example of such a configuration, and an alternative configuration is possible in which additional protective layer 201 and layer 203 are stacked further with another bonding layer 202 interposed. A multi-layer film member such as a coextrusion film having no bonding layer may alternatively be used.

Since the purpose is to improve gas blocking performance, a single protective layer 201 having high gas blocking properties as shown in FIG. 31B may be used.

Possible materials for the protective layer 201 include materials having high gas blocking properties such as polyvinylidene chloride (PVDC), polyvinyl chloride (PVC), ethylenevinyl alcohol (EVOH), polyacrylonitrile (PAN), polyamide-type nylon, and polyimide. Since a material having excellent gas blocking properties is used for the tank sheets 106 that forming a part of the ink tank as described above, the tank sheets 106 may be used as the protective layers 201.

Referring to materials used for the layer 203 bonded to the frame 115, the layer may be made of PP or PE that is a polyolefine-type material similar to the material of the frame taking ease of assembly into consideration or may be made of nylon (NY) or polyethylene terephthalate (PET) to provide softness and strength.

The present embodiment is aimed at improvement of the gas permeability of the frame 115 for the following reasons.

Referring to literature data of the materials for the ink tank 127, PP and PVDC have oxygen permeability of 1.70 and 0.0038 [$(cm^3 \times cm)/(cm^2 \times sec \times Pa)$], respectively. PP is considered to have gas permeability that is 450 times that of PVDC. Referring to relative quantities of gas permeation of the sheets 106 for which PVDC or EVOH is used and the frame 115 for which PP is used in the present embodiment taking the areas and thicknesses thereof into consideration, the permeation of gases through the frame 115 is 8 to 10 times the permeation of gases through the sheets 106. The quantity of gas permeation through the frame 115 can be reduced to 10% or less of that of existing parts by welding or bonding a material having such high gas blocking performance as the film member 200 of the present embodiment to the frame 115.

The above materials are preferable materials which not only have gas blocking properties but also prevent evaporation of ink to the outside. Such a consideration to evaporation makes it possible to achieve preferable characteristics also in terms of ink preservation in that ink in the ink tank is subjected to less change in its composition in a long term. PP and PVDC have water vapor permeability of 51 and 7 [$(cm^3 \times cm)/(cm^2 \times sec \times Pa)$], respectively, according to literature data.

Figure 32:
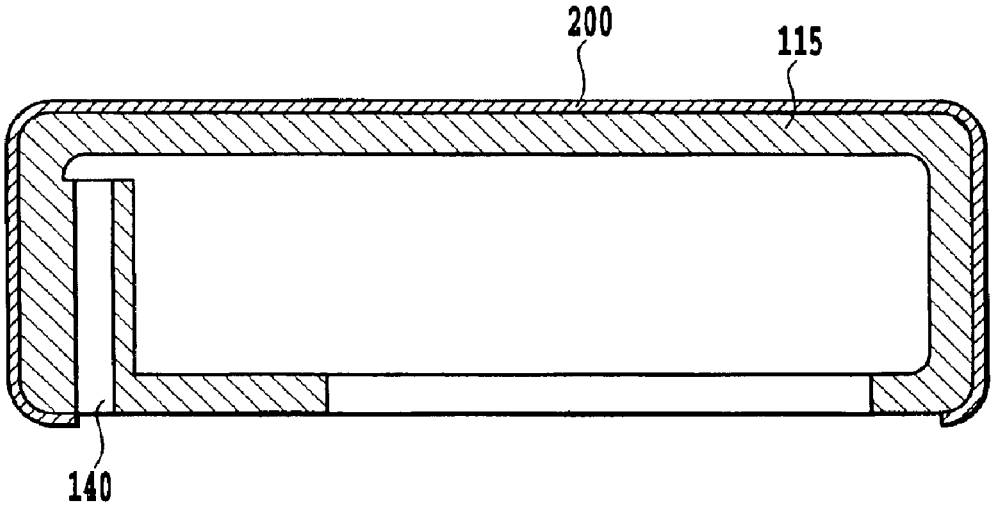
FIG. 32 is a vertical sectional view of the ink tank shown in FIG. 30.
Figure 33A:
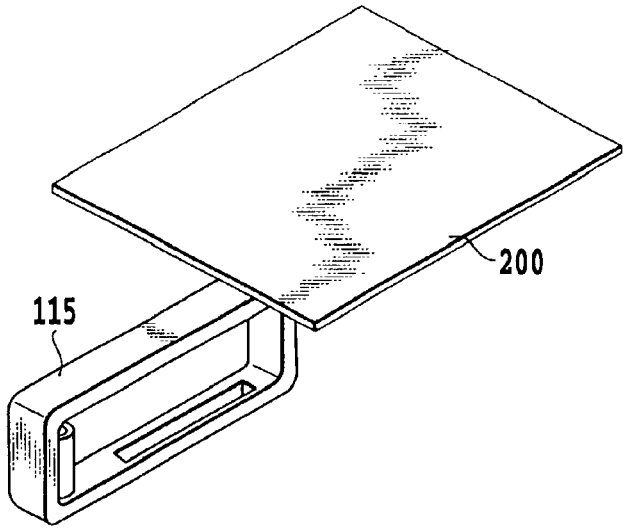
FIGS. 33A to 33D show steps of mounting a film member to the ink tank shown in FIG. 30 prior to the manufacture of the same, FIG. 33A being a perspective view for explaining a state before the mounting of the film member to a frame that constitutes the ink tank, FIG. 33B showing a step of thermally welding the film member to a top surface of the frame, FIG. 33C showing a subsequent step of thermally welding the film member to one side surface of the frame, FIG. 33D showing a subsequent step of thermally welding the film member to another side surface of the frame.
Figure 33B:
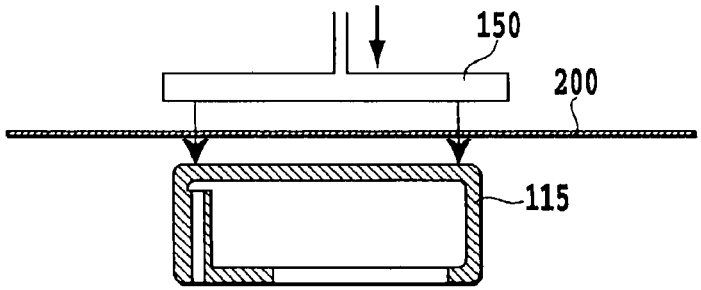
Figure 33C:
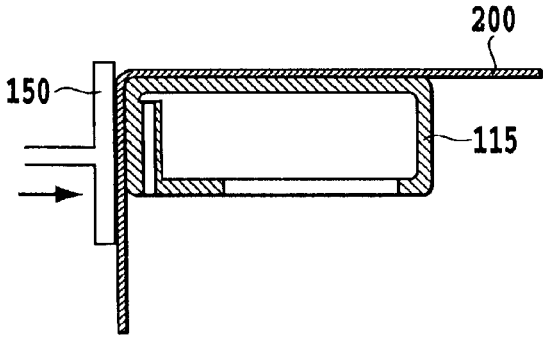
Figure 33D:
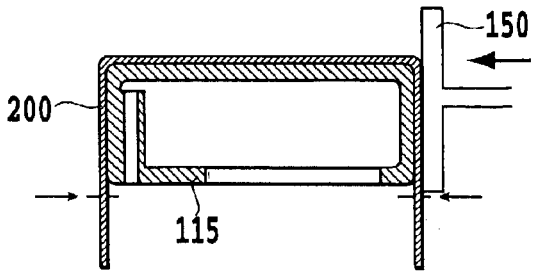

FIG. 32 shows an embodiment in which an outer surface of the frame 115 is covered with a multi-layer film member 200. In FIG. 32, reference numeral 140 represents a supply/exhaust pipe for supplying ink into the ink tank and exhausting gases that have entered the ink tank.

Figure 34:
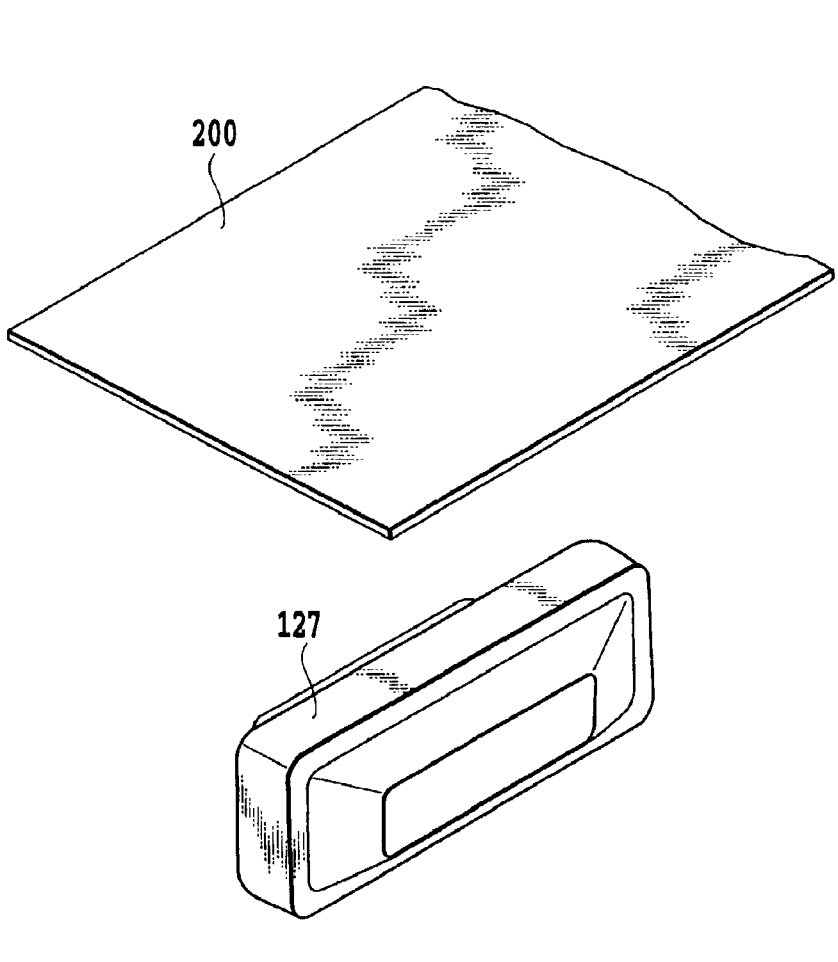
FIG. 34 is a perspective view for explaining mounting of a film member to the ink tank shown in FIG. 30 after the manufacture of the same.

FIGS. 33A to 33D and FIG. 34 show steps of bonding and welding a multi-layer film member 200 to a frame 115. FIGS. 33A to 33D show an example in which a multi-layer film member 200 is bonded or welded to a frame 115 before it is assembled into an ink tank, while FIG. 34 shows an example in which a multi-layer film member 200 is bonded and welded to a frame 115 of an ink tank 127 after the ink tank is assembled.

Referring to FIGS. 33A to 33D, the layer that is bonded to the frame 115 is made of the same material as that of the frame 115. The multi-layer film member 200 that is slightly wider than the width of the frame is horizontally placed on the frame 115, and a heat head 150 is applied from above to thermally weld a horizontal section of the frame 115 and the film member 200 (see FIGS. 33A and 33B). Then, the multi-layer film member 200 and the heat head 150 are applied to one side surface of the frame 115 in parallel to thermally weld them in a similar way (see FIG. 33C). Similarly, the multi-layer film member 200 and the heat head 150 are applied to the other side surface of the frame 115 in parallel to thermally weld them in a similar way (see FIG. 33D). Finally, the parts of the sheet protruding from the frame 115 are cut off. In the example shown in FIG. 34, the multi-layer film member 200 can be welded through similar steps, after the ink tank 127 is assembled.

When using a multi-layer film member having a material that can not be thermally welded on the surface thereof to be bonded to the frame 115 or a single-layer film member which is difficult to weld to the frame 115, the frame 115 and the film member 200 may be bonded using an adhesive instead of thermally welding them to assemble an ink tank having high gas blocking properties.

Figure 35:
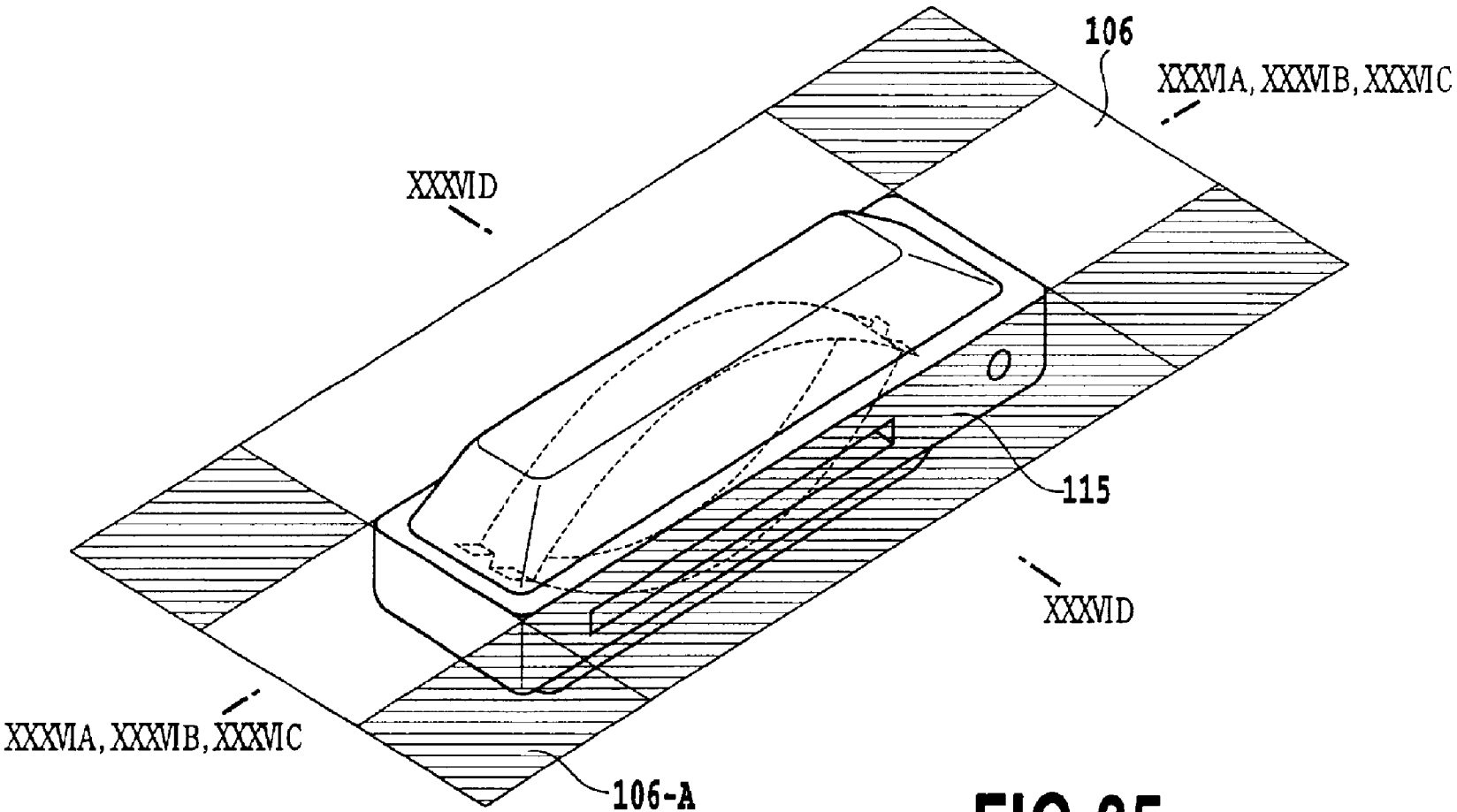
FIG. 35 is a perspective view for explaining mounting of a film member to the ink tank shown in FIG. 30 during the manufacture of the same.
Figure 36A:
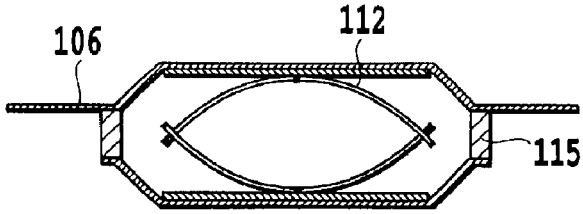
FIGS. 36A to 36D show steps of thermally welding the film member in FIG. 35 to a frame, FIG. 36A being a sectional view taken along the line A—A in FIG. 35, FIG. 36B showing a step of thermally welding the film member (sheet) to one side surface of the frame in the state in FIG. 36A, FIG. 36C showing a subsequent step of thermally welding the sheet to another side surface of the frame, FIG. 36D showing a subsequent step of thermally welding the sheet to a top surface of the frame.
Figure 36B:
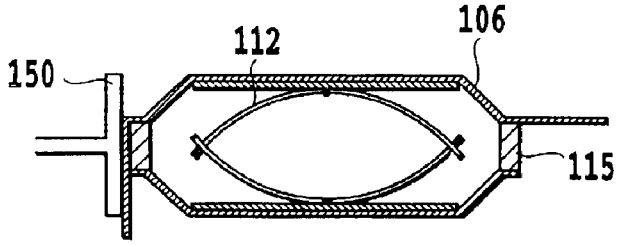
Figure 36C:
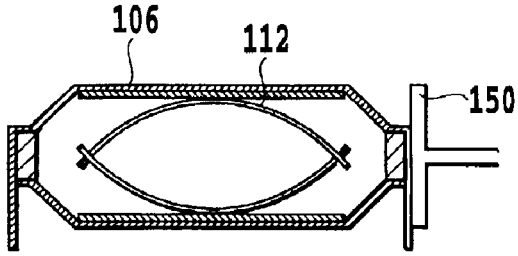
Figure 36D:
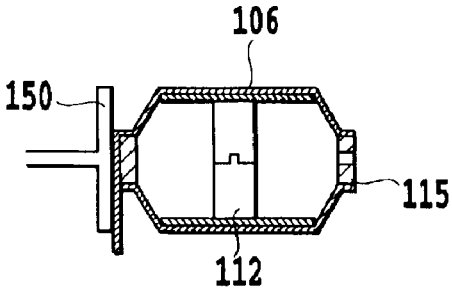

FIG. 35 shows an example in which a tank sheet 106 is used as the film member 200. FIG. 35 shows an ink tank immediately before the sheet cutting step shown in FIG. 15B among ink tank manufacturing steps at which an ink tank is nearly completed. As shown in FIG. 35, shaded parts 106-A (three parts in FIG. 31) of a sheet 106 that has been chosen taking gas blocking properties into consideration (or that has high gas blocking properties) are cut before covering a frame 115 with the tank sheet 106.

FIGS. 36A to 36D show a case in which the sheet 106 is thermally welded during the manufacture of the ink tank as shown in FIG. 35. As shown in these figure, parts of the sheet 106 that have been left uncut may be thermally welded to respective surfaces of the frame 115 using the heat head 150, and redundant parts of the sheet 106 may be cut off to fabricate a desired ink tank.

In any case, there is no need for applying the film member 200 to the predetermined surface of the frame 115 (for instance, in FIG. 2, the surface of the frame 115 where the ink supply port 128 is provided, or the surface of the frame 115 where the first and second ink supply ports 1128 and 1129 of the ink tank are formed of a structure to be applied with the intermittently supplying system as described below), as apparent from the configuration of the same. The order of thermally welding the film member or sheet to the frame is not limited to the illustrated order.

(Example of Structure of Inkjet Printing Apparatus Utilizing Intermittent Supply System)

A basic structure of the present invention is applicable not only to the ink tanks of on-carriage system as mentioned above, but also to ink tanks of intermittent supply system.

One of methods of supplying ink to a printing head applied to an inkjet printing apparatus is a type in which a supply system is configured such that an amount of ink is always or continuously supplied to the printing head according to the amount of ink ejected (hereinafter referred to as a continuous supply type). The continuous supply type is further categorized into two types, for example, when it is used in an inkjet printing apparatus of a type referred to as a serial type in which a printing head is scanned back and forth in predetermined directions relative to a printing medium and in which the printing medium is transported in a direction substantially orthogonal thereto to form an image. One is a type referred to as the on-carriage type described above in which ink is supplied by integrally or detachably attaching an ink tank to a printing head that is carried and moved back and forth (main scanning) by a carriage. The other is a tube supply type in which an ink tank that is separate from a printing head carried on a carriage is fixedly installed in a part of a printing apparatus other than the printing head and in which the ink tank is connected to the printing head through a flexible tube to supply ink. In some of the latter type, a second ink tank that serves as an intermediate tank between an ink tank and a printing head is mounted on the printing head or the carriage.

The other method of supplying ink is a type in which a printing head is provided with a reservoir (sub-tank or second ink tank) for reserving a predetermined amount of ink and in which a supply system is configured such that ink is supplied to the reservoir from an ink supply source (main tank or first ink tank) at appropriate timing or intermittently (hereinafter referred to as an intermittent supply type).

Figure 37:
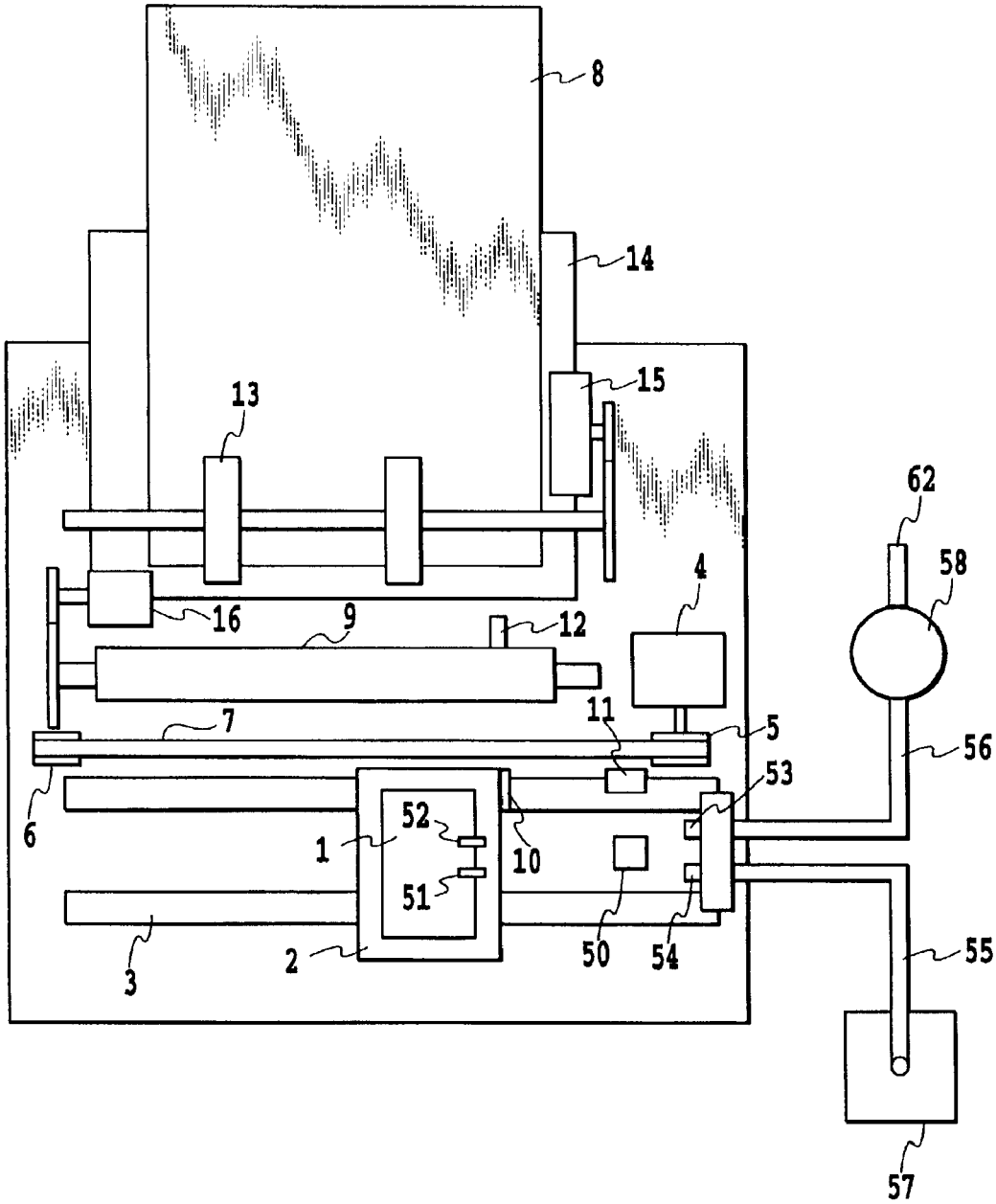
FIG. 37 is a schematic plan view showing a general configuration of an inkjet printing apparatus employing an intermittent supply method.

FIG. 37 is a schematic plan view showing a general structure of an inkjet printing apparatus utilizing an intermittent supply system.

In the structure in FIG. 37, a printing head unit 1 is replaceably mounted on a carriage 1. The printing head unit 1 has a plurality of printing heads and an ink tank container or chamber which contains a plurality of ink tanks (also referred to as "second ink tanks" or "sub-tanks" in relation to first ink tanks described later) for directly supplying ink to the plurality of printing heads, and there is provided a connector (not shown) for transmitting signals such as a drive signal for driving the head section to cause an ink ejecting operation of a nozzle. The carriage 2 on which the printing head unit 1 is positioned and replaceably mounted is provided with a connector holder (electrical connecting section) for transmitting signals such as the drive signal to the printing head unit 1 through the connector.

The carriage 2 is guided and supported by a guide shaft 3 provided on a main body of the apparatus and extending in a main scanning direction such that it can be moved back and forth along the guide shaft. The carriage 2 is driven and controlled with respect to its position and movement by a main scanning motor 4 through transmission mechanisms such as a motor pulley 5, a driven pulley 6, and a timing belt 7. For example, a home position sensor 10 in the form of a transmission type photo-interrupter is provided, and a blocking plate 11 is disposed in a fixed part of the apparatus associated with a home position of the carriage such that it can block an optical axis of the transmission type photo-interrupter. Thus, when the home position sensor 10 passes through the blocking plate 11 as a result of the movement of the carriage 2, the home position is detected, and the position and movement of the carriage can be controlled using the detected position as a reference.

Printing medium 8 that are printing paper or plastic sheets are separately fed one by one from an automatic sheet feeder (hereinafter referred to as an ASF) by rotating a pick-up roller 13 with an ASF motor 15 through a gear. Further, the medium is transported through a position (printing section) in a face-to-face relationship with a surface of the printing head unit 1 where ejection openings are formed as a result of the rotation of a transport roller 9 (sub scanning). The transport roller 9 is driven by transmitting the rotation of a line feed (LF) motor 16 through a gear.

At this time, judgment on whether the paper has been fed and decision of a print starting position on the printing medium in a sub scanning direction is performed based on output of a paper end sensor 12 for detecting the presence of a printing medium disposed upstream of a printing position on a printing medium transport path. The paper end sensor 12 is used to detect a rear end of a printing medium 8 and to decide a final printing position on the printing medium in the sub scanning direction based on the detection output.

The printing medium 8 is supported by a platen (not shown) at a bottom surface thereof such that a flat surface is formed in a portion thereof to be printed. In doing so, the printing head unit 1 carried by the carriage 2 is held such that the surface thereof where the ejection openings are formed protrudes downward from the carriage in parallel with the printing medium 8. For example, the printing head unit 1 is an inkjet printing head unit having a structure for ejecting ink utilizing thermal energy and having an electrothermal transducer for generating thermal energy that causes film boiling of ink. That is, the printing head of the printing head unit 1 performs printing by utilizing the pressure of bubbles generated as a result of film boiling of ink caused by the thermal energy applied by the electrothermal transducer to eject ink. Obviously, a different type of unit such as a unit that ejects ink utilizing a piezoelectric device may be used.

Reference numeral 50 represents a recovery system mechanism that has a cap member used for an operation of recovering suction of ink from the printing head unit 1 and for protecting the surface of the printing head where the ejection openings are formed. The cap member can be set in positions where it is joined to and detached from the surface where the ejection openings are formed by a motor that is not shown. Operations such as the suction recovery operation of the printing head are performed by generating a negative pressure in the cap member by a suction pump which is not shown in the joined state. The surface of the printing head where the ejection openings are formed can be protected by keeping the cap member in the joined state when the printing apparatus is not used.

Reference numeral 51 represents a valve unit provided on the printing head unit side for coupling the printing head unit 1 to an ink supply source. Reference numeral 54 represents a valve unit provided at the ink supply source side to be paired with the valve unit 51. Reference numeral 52 represents a valve unit provided on the printing head unit side for coupling the printing head unit 1 to an air pump unit. Reference numeral 53 represents a valve unit provided on an air pump unit side to be paired with the valve unit 52.

The valve units 51 through 54 are in contact and coupled with the respective valve units to allow ink and air to flow between the valve units when the carriage 2 is located at the home position outside a printing area in the main scanning direction or at a position in the vicinity of the same. The valve units are decoupled from each other when the carriage 2 moves away the position toward the printing area, and the valve units 51 and 54 automatically enter a closed state as a result of the decoupling. On the contrary, the valve unit 52 is always in an open state.

Reference numeral 55 represents a tube member that is coupled with a first ink tank 57 to supply ink to the valve unit 104. Reference numeral 56 represents a tube member for an air pressure or pneumatic circuit, the tube member being coupled with a pump unit 58 for pressurization and depressurization. Reference numeral 62 represents a suction and exhaust port of the pump unit 58.

It is not essential to configure each of the tube members as an integral unit, and it may be configured by combining a plurality of tube elements. A plurality of first and second ink tanks, tubes and valve units communicating therebetween are provided, corresponding to the number of printing heads.

An intermittent ink supply method is adopted in the apparatus in FIG. 37. Specifically, a printing head unit 1 having an ink tank container containing relatively small second ink tanks and printing heads are mounted on a carriage 2; relatively large first ink tanks 57 are provided in a region of the printing apparatus other than the carriage; and the carriage 2 is set in a position such as a home position at appropriate timing to couple valve units such that a supply system is formed to supply ink from the first ink tank 57 to the second ink tank. During main scanning of the carriage 2, the ink supply system between the first and second ink tanks is spatially separated to achieve fluidic isolation between the first and second ink tanks.

Let us discuss a continuous supply system employs the tube supply method in which an ink tank is fixedly installed on a printing apparatus separately from a printing head that is mounted on a carriage in a region other than the region of the printing head and in which ink is supplied by connecting the ink tank and the printing head through a flexible tube. In this case, while members moving with the carriage during main scanning can be made somewhat compact, the tube member that supplies ink by connecting the printing head on the carriage and the ink tank located in a region other than the carriage requires a space to move to follow up the carriage, which makes it difficult to achieve compactness accordingly. Further, there is a recent tendency to scan a carriage at a high speed to accommodate an increase in the speed of a printing operation, which results in fluctuations of the pressure of ink in the ink supply system for the printing head as a result of severe shaking of the tube that follows up the carriage. It is therefore strongly demanded to provide various complicated pressure buffering mechanisms to suppress pressure fluctuations, which also makes it difficult to achieve compactness.

On the contrary, the intermittent supply method as in the above example basically makes it possible to solve the problem of the size of moving members such as an ink tank that has limited efforts toward compactness in the case of the continuous supply method and various problems attributable to shaking of a tube.

(Another Example of Structure of Inkjet Printing Apparatus Utilizing Intermittent Supply System)

The intermittent supply system in FIG. 37 has a structure in which the valve units are coupled only when the second ink tank is charged with ink and in which the ink supply system between the first and second ink tanks is spatially disconnected during a printing operation. An intermittent supply system may be employed in which the ink channel or a fluid path is blocked with a valve instead of such disconnection to achieve fluid isolation between the first and second ink tanks.

Figure 38:
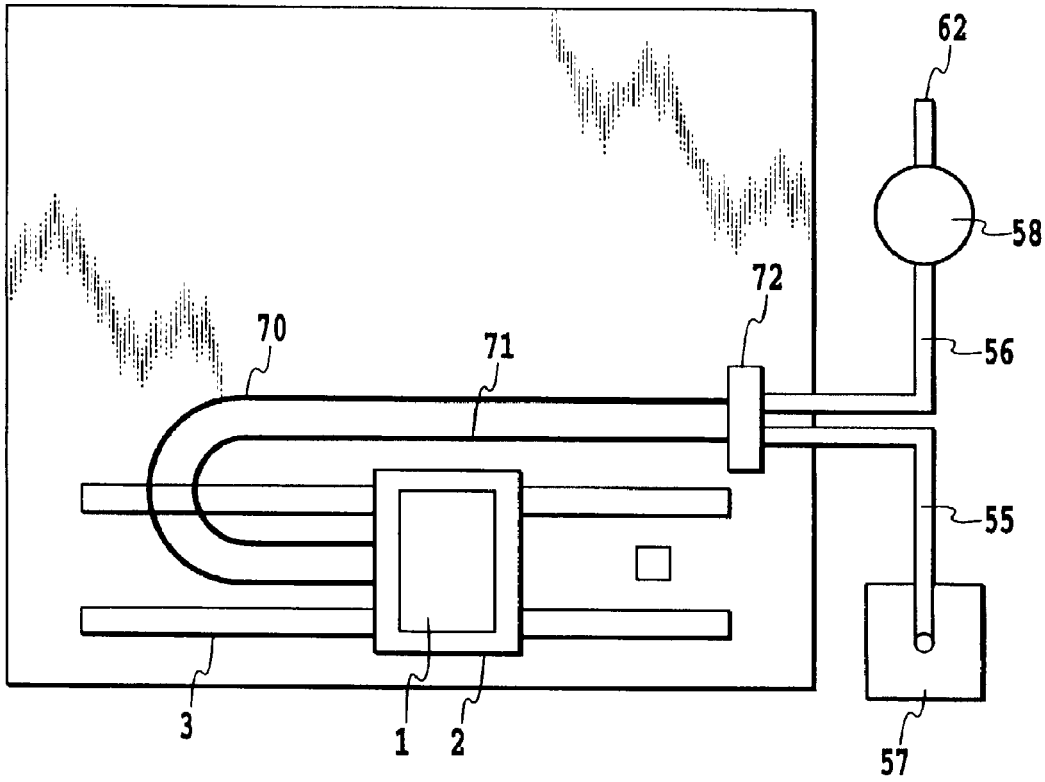
FIG. 38 is a schematic plan view showing a general configuration of an inkjet printing apparatus employing an intermittent supply system utilizing a normally connected tube mechanism unlike the configuration in FIG. 37.

FIG. 38 schematically shows an inkjet printing apparatus in which an intermittent supply system utilizing a normally connected tube mechanism is used. For simplicity, FIG. 38 does not show parts which can be configured similarly to those in FIG. 37 and which are not related to the description of the supply system of the present example.

In FIG. 38, reference numeral 70 represents a flexible tube for an air pressure circuit that is connected to a second ink tank of a printing head unit at one end thereof and connected to a pump unit 108 for pressurization and depressurization through an electromagnetic valve unit 152 and a tube member 106 for the air pressure circuit at another end thereof. Reference numeral 71 represents a flexible tube for supplying ink that is connected to the second ink tank of the printing head unit at one end thereof and connected to first ink tank 57 through the electromagnetic valve unit 72 and a tube member 55 for supplying ink at another end thereof.

That is, an intermittent supply system may be configured even using such a normally connected tube mechanism by interposing units for opening to form and closing to block a channel such as the electromagnetic valve unit 72 and by controlling the opening and closing of the same appropriately during an operation of charging the second ink tank with ink and a printing operation.

The intermittent supply method as in the above example basically makes it possible to solve various problems attributable to shaking of a tube in the case of the continuous supply method using a tube.

As described later, even when plural types of inks 69 are used to accommodate color printing, the structure of an ink tank container is made compact and simple by appropriately configuring the same, which also makes it possible to achieve a further reduction of the size of a print head unit and a printing apparatus.

(Ink Tank applied to Intermittent Supply System and Manufacturing Method Thereof)

An ink tank in the form of a sub-tank applied to an intermittent supply system and a manufacturing method thereof will be described.

Figure 39:
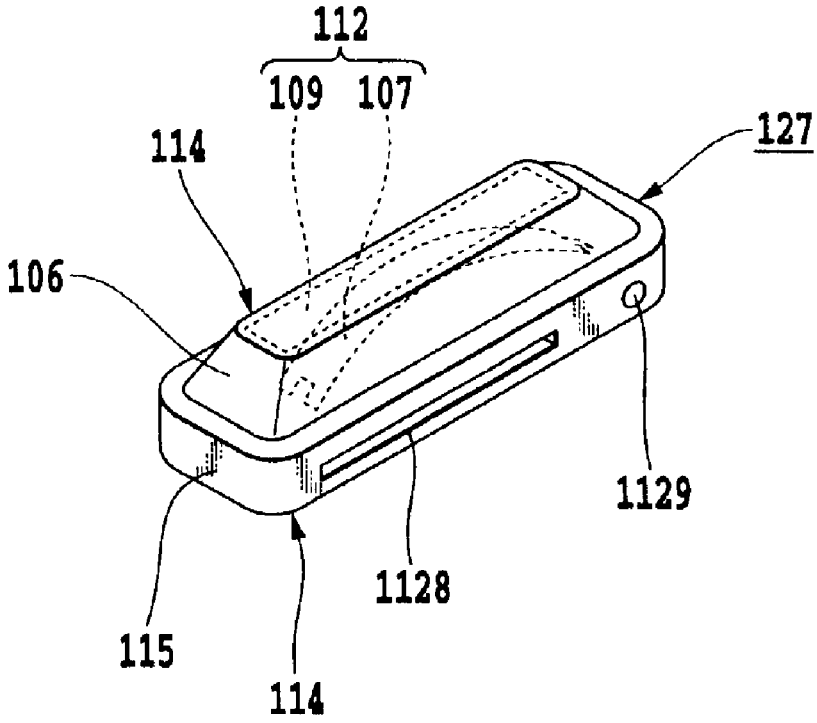
FIG. 39 is a perspective view of an ink tank that can embody the inkjet printing apparatus shown in FIG. 37 or 38.

FIG. 39 is a perspective view of an ink tank (ink container) 427 having a structure that is basically similar to that in FIG. 10 and that is an enclosed structure in which top and bottom spring/sheet units 114 are mounted at openings at the top and bottom of a square frame 115. A spring/sheet unit 114 is constituted by a spring unit 112 having a spring 107 and a pressure plate 109 and a flexible tank sheet (movable member) 106. The frame 415 is formed with a first ink supply port 1128 for supplying ink from the ink tank 127 to a recording head and a second ink supply port 1129 for introducing ink from a main tank to the ink tank 127.

The tank sheet in such a configuration can be formed through a forming step similar to that shown in FIGS. 11A, 11B, and 11C. The spring unit can be manufactured through a manufacturing step similar to that in FIG. 12A, and the spring/sheet unit can be manufactured in a manner similar to that shown in FIG. 12B.

Figure 40A:
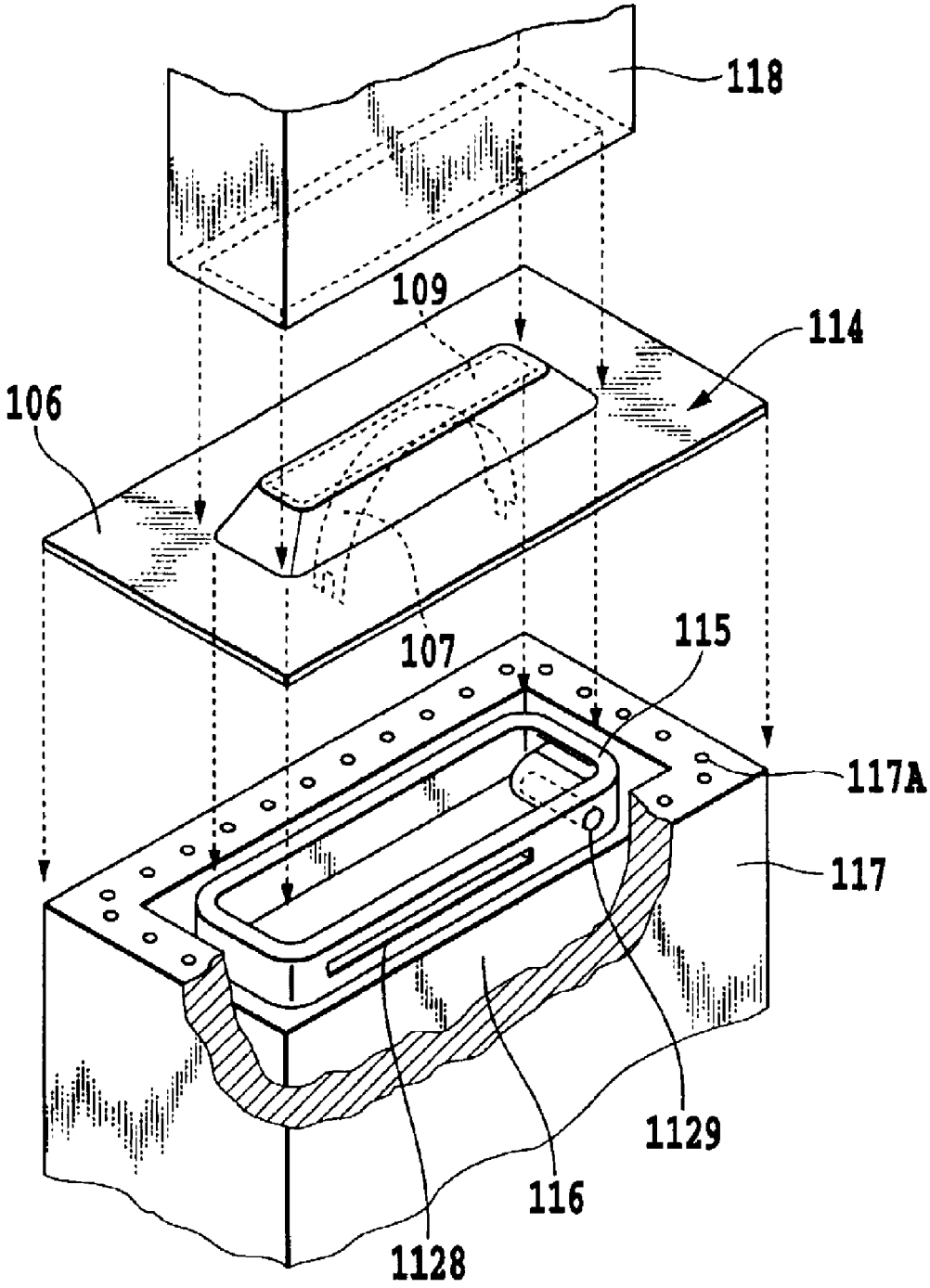
FIGS. 40A and 40B are illustrations of steps of manufacturing a spring/sheet/frame unit of the ink tank in FIG. 39.
Figure 40B:
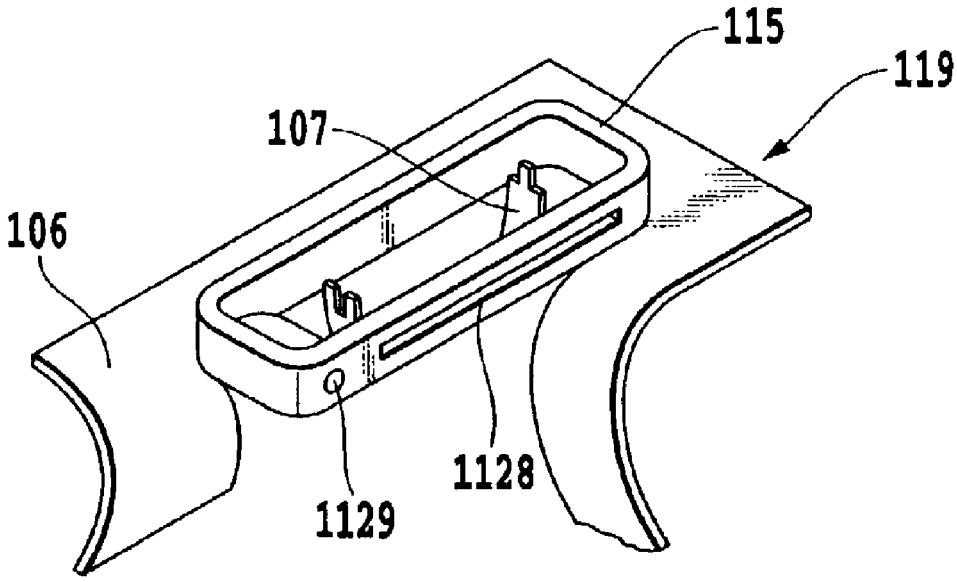

The spring/sheet unit 114 is welded to the frame 115 having the ink supply port 315 and the vent section 301 formed thereon at the step shown in FIG. 40A, and parts of the tank sheet 106 protruding from the frame 115 are then cut off at the step in FIG. 40B to complete a spring/sheet/frame unit 119.

Thereafter, the spring/sheet unit and the spring/sheet/frame unit may be coupled with each other in a manner similar to that shown in FIGS. 14, 15A, and 15B to obtain the ink tank 127 shown in FIG. 39. An inkjet cartridge having a plurality of such ink tanks 427 mounted thereon may be provided.

(Mounting of Ink Tank to Recording Head)

Figure 41:
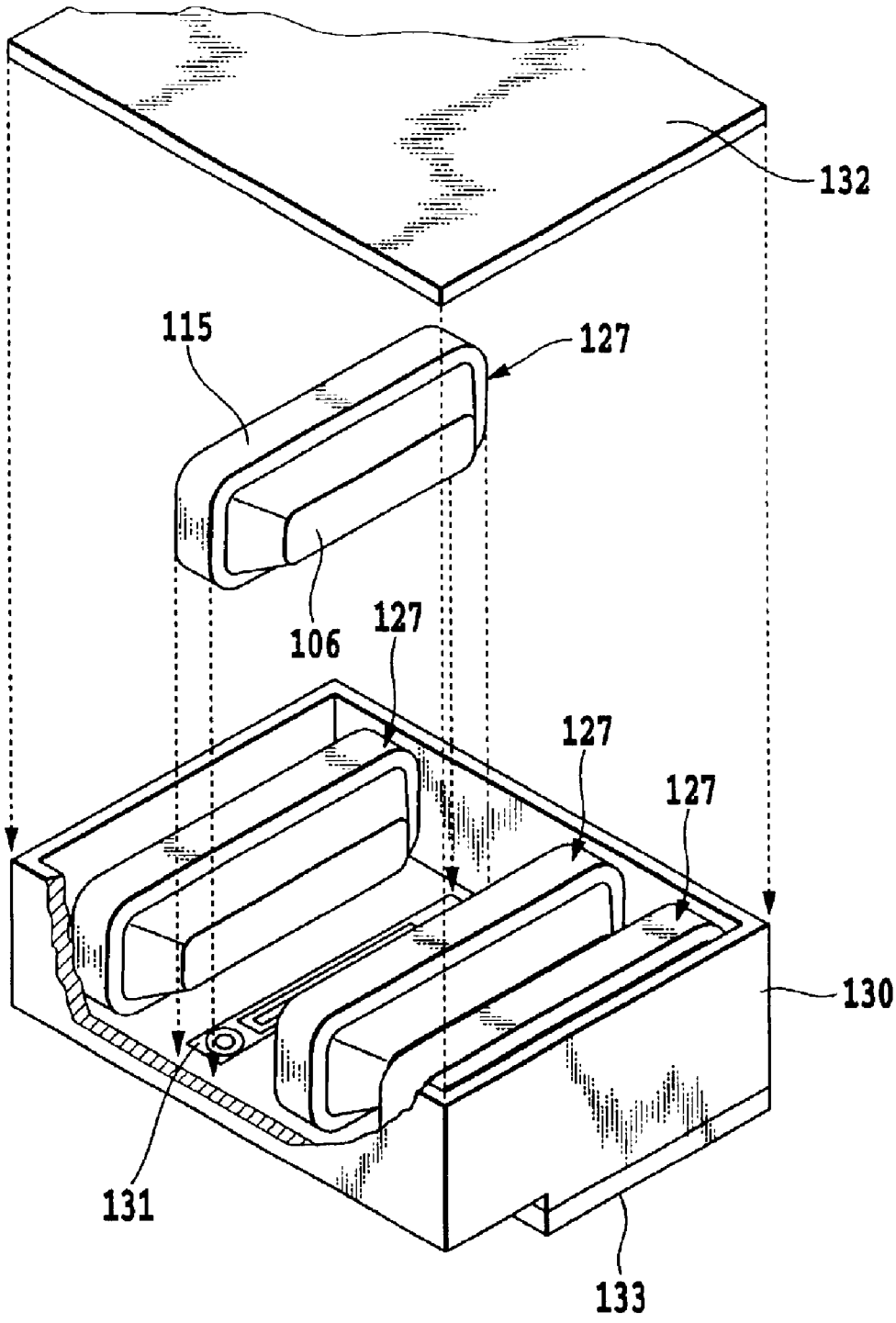
FIG. 41 is an illustration of a step of mounting the ink tank in FIG. 39.

FIG. 41 is an illustration of a step of mounting the ink tank 127 to a recording head.

A head chip 133 serving as a recording head is mounted in an ink tank containing chamber 130, and a plurality of ink tanks 127 are mounted in the ink tank containing chamber 130. The ink tanks 127 are mounted to an ink tank mounting section 131 using welding or bonding. The ink tanks 127 of the present embodiment are mounted with the ink supply ports 128 and 129 located on the bottom thereof. Thereafter, a lid 132 is mounted to an opening of the ink tank containing chamber 130 using welding or bonding to form a semi-enclosed space in the ink tank containing chamber 130. A recording head having ink tanks is thus configured. The head chip 133 may serve as an inkjet recording head. The inkjet recording head may have a configuration in which an electrothermal transducer is provided to eject ink droplets from an ink ejection port, for example. Specifically, a configuration may be employed in which film boiling of ink is caused by heat generated by the electrothermal transducer and in which ink droplets are ejected from the ink ejection port utilizing the foaming energy. An inkjet cartridge can be configured by combining such an inkjet recording head and ink tanks.

Figure 42:
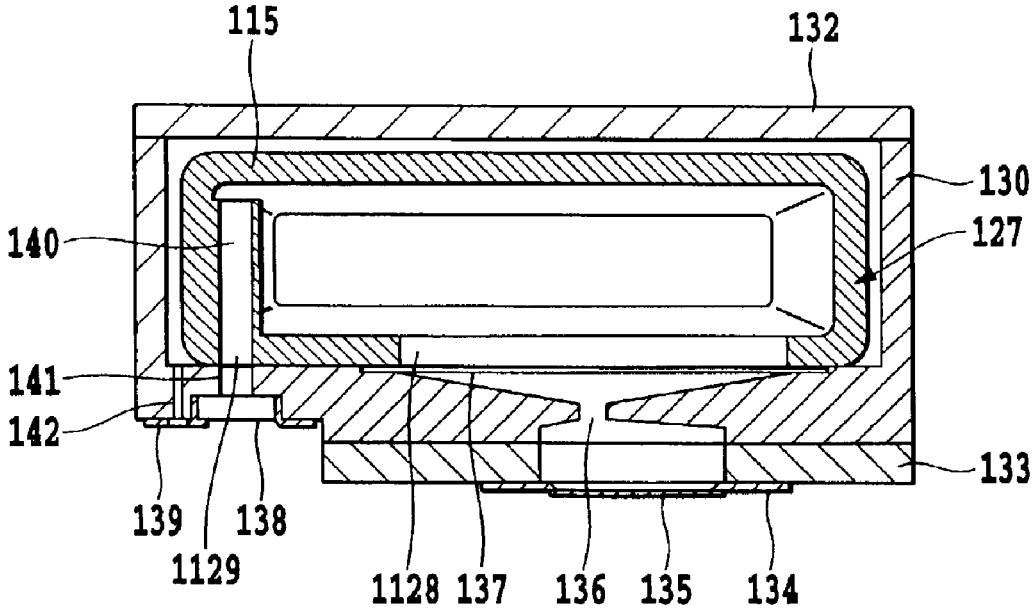
FIG. 42 is a sectional view of major parts in a mounted state of the ink tank in FIG. 41.

FIG. 42 is a sectional view of the ink tank containing chamber 130 in FIG. 41 having ink tanks therein.

Ink can be reserved in the ink tanks 127, and the ink is supplied from the first ink supply ports 1128 of the ink tanks 127 to a supply channel 136 through a filter 137 and is then further supplied to the head chip 133. A heater board 134 is bonded to the head chip 133 of the present embodiment to form an inkjet recording head, and the heater board 134 is formed with ink paths and orifices and is provided with electrothermal transducers (heaters) to be able to eject ink supplied from the ink tanks 127. The ink tanks 127 can be charged with ink through the second supply ports 1129. Specifically, a joint seal 138 for preventing ink leakage and allowing ink charging is secured to the second ink supply port 1129 with a joint seal plate 139 such that it seals an opening 141 at the bottom of the tank containing chamber 130. The joint seal 138 is constituted by a flexible rubber member and provided with a slit into which a supply pipe in the form of a needle can be inserted. When ink is supplied to the ink tank 127, the needle-like supply pipe is inserted into the slit of the joint seal 138, and ink is supplied to the ink tank 127 through the supply pipe. When ink is not supplied to the ink tank 127, since the slit is closed because of the elasticity of the joint seal 138, ink will no leak out. Reference numeral 140 represents a communication channel that is in communication with the second supply port 1129, and the communication channel may be formed in advance such that it extends through the frame 115.

The ink tank containing chamber 130 having the generally enclosed structure formed by the lid 132 is in communication with the outside only through a small hole 142. The interior of the ink tank containing chamber 130 can be isolated from the atmosphere by closing the small hole 142. The pressure in the ink tank containing chamber 130 can be reduced to increase a negative pressure in the ink tanks 127 by exhausting air from the ink tank containing chamber 130 through the small hole 142.

Ink can be automatically sucked and supplied into the ink tanks 127 through the second ink supply ports 129 by repeating depressurization and pressurization of the interior of the ink tank containing chamber 130. At this time, since the springs 107 is elastically deformed with high response to changes in the pressure in the ink tank containing chamber 130, the ink tanks can be preferably used as compact ink tanks that are frequently replenished with ink.

(Configuration and Operation of Ink Tank Container and Sub-Tank)

Figure 43:
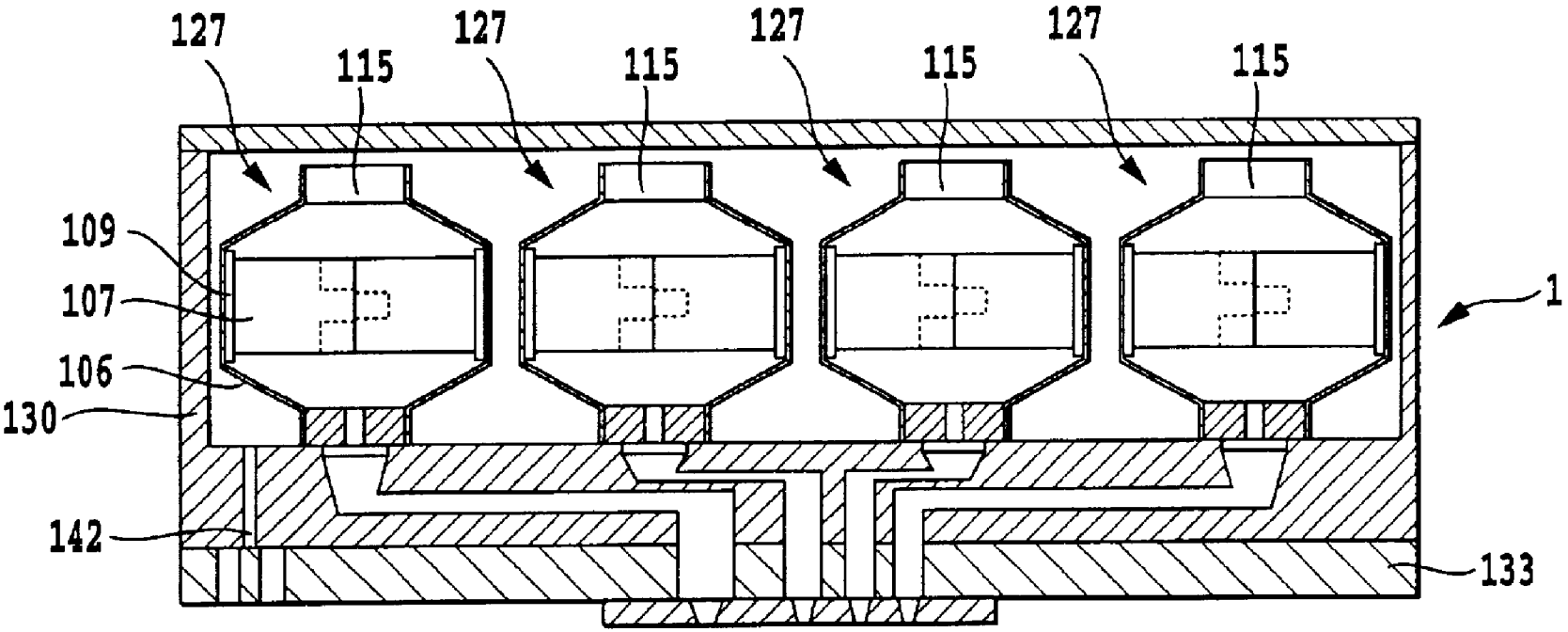
FIG. 43 is a schematic sectional view of an ink tank container (ink tank containing chamber) in FIG. 41 taken along a main scanning direction.

FIG. 43 is a schematic sectional view of the ink tank container (ink tank containing chamber 130) in FIG. 41 taken in the direction of main scanning. As apparent from FIGS. 41 and 43, by mounting the four independent sub-tanks 127 for reserving inks in four tones in the ink tank container of the present embodiment as described above, they are contained in parallel in a direction corresponding to the main scanning direction without interposing any partition or partition wall between them. In the present embodiment, since the frame 115 which also serves as a member for maintaining the attitude or orientation of the pair of flexible thin film members (tank sheets) 106 is directly mounted and secured in the ink tank containing chamber 130, each sub-tank 127 is kept in a position free from mutual interference.

The shape of the four sub-tanks 127 changes in accordance with the amount of ink reserved therein to change the internal volume, and each tank has a structure for maintaining its shape independently. Specifically, the four sub-tanks 127 have an enclosed type ink containing structure in which a pair of flexible thin film members (tank sheets) 106 are provided in a face-to-face relationship and, in each of the tanks, there is provided springs 107 for generating an adequate negative pressure in a range in which ink can be ejected from a nozzle in equilibrium with a force to hold meniscuses formed at the nozzle until the internal volume of the tank is minimized as a result of the progress of ink consumption and pressure plates 109 for regulating the displacement or deformation of the pairs of the springs 107 and tank sheets 106 facing each other proceeds in a substantially parallel relationship when the internal volume changes.

The small hole 142 as a suction/exhaust port is provided in the ink tank container. The valve unit 52 is connected to the small hole 142. Since the valve unit 52 is normally open when it is not coupled with the valve unit 53 of an air pump (during a printing operation, for example), the interior of the ink tank container is in communication with the atmosphere through the small hole 142 or the valve unit 52 in such a case. Therefore, the deformation (contraction) of the sub-tanks 127 will not be hindered when ink is consumed as a result of an ejecting operation, for example.

The shape of each of the four sub-tanks 127 changes independently as ink is consumed. Specifically, their shapes variously change because the amounts of remaining inks become unevenness among the ink types according to the mount of use of ink in each color that depends on the image to be formed.

Figure 44:
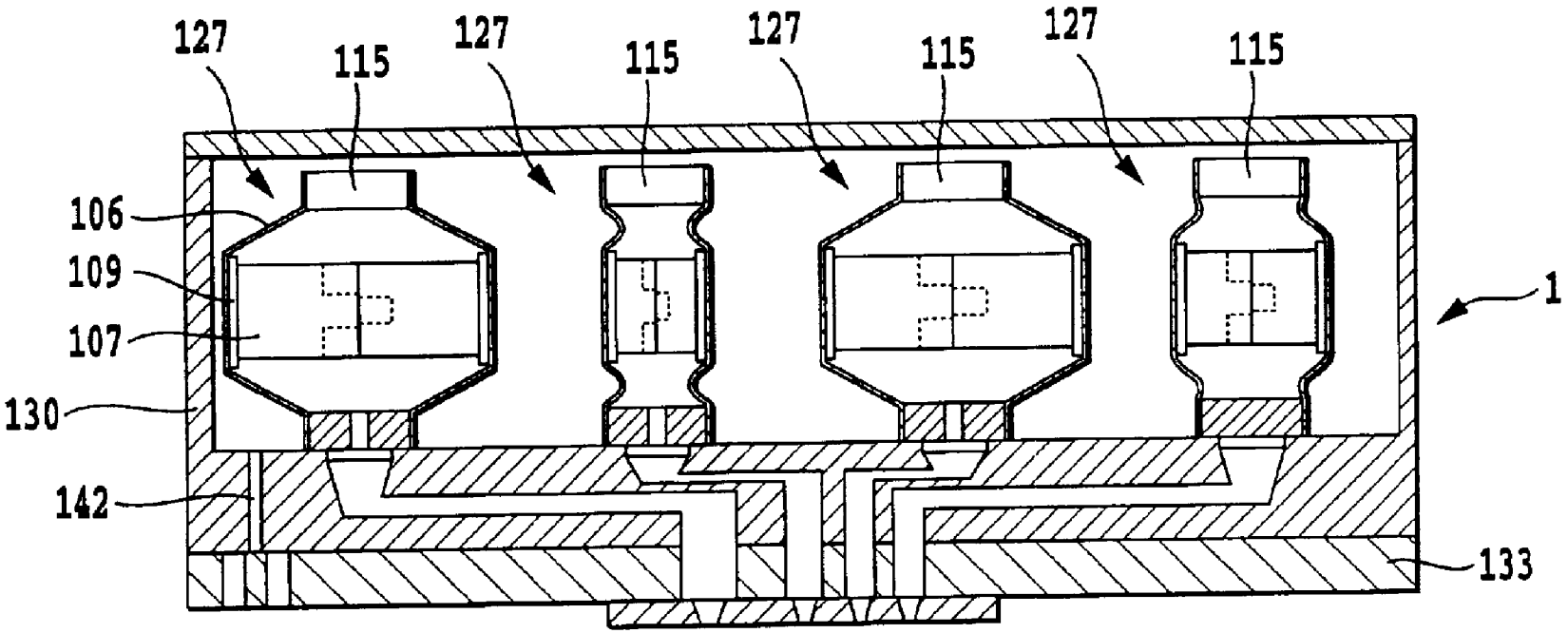
FIG. 44 schematically shows an unbalanced state between remaining quantities of ink types that follows that state shown in FIG. 43 depending on the amounts of use of the inks in respective tones according to an image to be formed.

FIG. 44 shows such a state. For example, when inks are charged in this state, the carriage 2 is set in a home position located outside a printing area in the main scanning direction of the same or in a position in the vicinity of the same, and valve units associated with each other are connected in the that position to allow inks and air to flow through the valve units. When a depressurization operation of the pump unit 58 is then caused to depressurize the interior of the ink tank container, each of the sub-tanks 127 absorbs ink from the respective first ink tank 57 and expands. Even when the mounts of remaining inks in the sub-tanks 127 as described FIG. 44 are different depending on the ink types, the expansion of each tank is stopped at a point in time when the ink is sufficiently charged to balance the depressurizing force with the tension of the tank sheet 106. That is, the present embodiment eliminates a need for performing fine control to charge a prescribed amount of ink of each type depending on differences between the amounts of remaining inks, in principle.

Since gases can enter and reside (accumulate) in each sub-tank 127 for some reason, an operation of pressurizing the interior of the ink tank container may be performed prior to the ink charging operation to discharge any gases residing in an upper part of the interior of the sub-tank 127 toward the first ink tank.

When the springs 107 are deformed toward a neutral position or pressurizing position when the sub-tank 127 is sufficiently charged with ink and completely expanded, a pressurizing operation may be performed for a short time after the ink charging operation to push the ink in the sub-tank 127 toward the first ink tank 57 slightly, thereby causing the sub-tank 127 to contract to allow the springs 107 to generate an adequate negative pressure.

Thus, one feature of the present embodiment is that prescribed mounts of inks is charged even if there is an increase in ink types only by disposing the sub-tanks 127 in a quantity to accommodate the ink types in the internal configuration of the ink tank container or print head unit, other peripheral mechanisms (e.g., the pump unit) being used commonly. This is a very advantageous technique in designing portable, low profile, or compact printer.

The present embodiment is basically characterized in that a plurality of sub-tanks are contained without any partition or partition wall interposed therebetween. It is therefore desirable that the plurality of sub-tanks are provided in positions and sizes that do not cause mutual interference and that they are provided in positions and sizes that do not cause mutual interference at least while the tanks continues expanding until they are fully charged with inks. Obviously, the tones of inks and the quantity of ink tanks provided and their positional relationship are not limited to the above embodiment and may be determined as desired as long as such conditions are satisfied. A design is also possible in which each type of ink is contained with a different capacity.

For example, in the case of a printing head configuration in which nozzles for ejecting black ink are provided in a wide range and a train of nozzles having relatively small ranges (each of which is about one-third of the range of the black nozzle) for cyan, magenta, and yellow are arranged beside the black nozzle to extend over the range of the same, cyan, magenta, and yellow sub-tanks may be provided in the direction of sub-scanning in parallel with each other beside a sub-tank for black having a great capacity.

The configurations of the ink tank container and sub-tanks according to the above embodiments are not limited to the printing apparatus in FIG. 37 having a configuration in which valve units are connected to charge the sub-tanks with ink and in which the ink supply system between the first ink tank and the sub-tanks are spatially disconnected during a printing operation. Instead, those configurations can be used in the printing apparatus in FIG. 38 that employs an intermittent supply system having a configuration in which fluidic isolation is achieved between the first and second ink tanks instead of disconnecting them in such a manner.

While an ink tank container has been described above as an ink tank containing chamber that is integrated with a printing head, they may be separably configured or provided as separate bodies. Further, embodiments having the ink tank containing chamber may be preferably used for printing apparatus employing the continuous supply system, specifically the on-carriage system as described above, because it contributes to size reduction.

(Others)

The above described embodiments are structured by providing convex sheets on both of the opposed ports of the flame having generally rectangular shape, but may be structured by providing the convex sheet on either side thereof.

Figure 45:
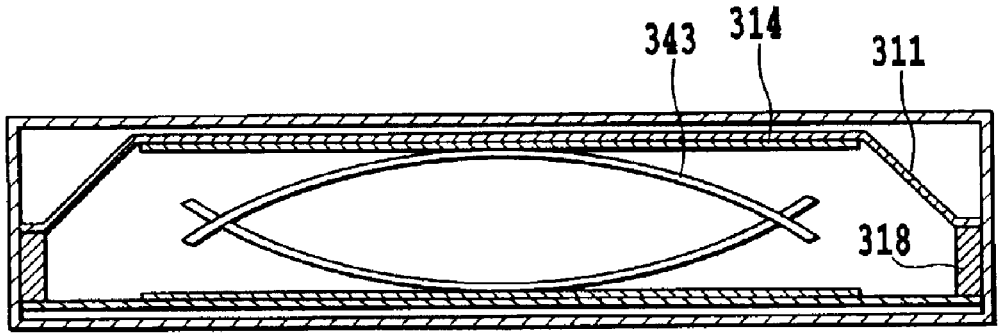
FIG. 45 is a schematic sectional view for explaining an ink tank according to still another embodiment.

The example of the above is illustrated in FIG. 45 wherein only one port of the flame 318 is provided with the sheet 311, and the other port is closed with a fixed member 340. In this case, the pressure plate may not be arranged on a side of the fixed member. In stead of providing such flame 318 and the fixed member 340 for closing, a box-like member having one side thereof being open may be employed with an arrangement of the sheet on the open side of the box-like member.

Further, although a shape of the convex sheet is illustrated as a substantial square frustum or truncated pyramid in the above example, the shape of the sheet may be formed as a triangle or the other polygonal frustum or a truncated cone.

Furthermore, although the upper surface is illustrated as a plane surface as shown in the above embodiments, any other shape may be employed as long as the shapes of the upper surface and the opposite surface thereof are defined so as not to produce a substantial dead space in a state of complete collapse (a state of maximum displacement) as shown in FIGS. 5D and 18D. In view of manufacturing efficiency, a plane surface will be most preferable.

Still further, in either cases where the displacement is cased toward the inner side of the ink tank as a discharge of ink, or where the displacement is cased toward the outside of the surfaces of the ink tank as a supply of outside ink, an arrangement of the pressure plate of a planar member is the most preferred in view of preventing a generation of an unfavorable negative pressure variation in the process of the displacement. Also, ununiformed deformation of the sheet as shown in FIGS. 19A–19D will result in a lowering of an ink containing efficiency as the ink tank. Therefore, in view of the foregoing, the planar member is preferred to be arranged. Such construction will be preferable for reconstruction of the convex shape of the sheet in both cases where the sheet is displaced to the maximum value as shown in FIGS. 5D and 18D and where an ink is introduced into the ink tank prior to which being placed to a position of the maximum displacement, as well.

It is preferable to employ a spring as a negative 80 pressure generating source as described above. This spring may be arranged not inside the ink tank but outside thereof. In view of the down sizing of the ink tank, the spring is preferred to be arranged inside the ink tank together with the pressure plate (a planar member). Also, in view of the improvement of the assembly accuracy, it is preferred to previously integrate the spring with the pressure plate.

As to a shape of the spring member, a coil spring may be employed. In view of the ink containing efficiency and ink consuming efficiency, it is more preferred to employ a pair of substantial U-shaped leaf springs as stated above.

A basic construction of a liquid containing tank according to the present invention can be preferably applied to any ink tank of on-carriage system or of intermittent supply system. The foregoing will be understood because the ink tank can be manufactured with approximately the same process in both cases employing on-carriage system or intermittent supply system.

As stated above, variations and modifications on the present invention may be made without departing from a scope of the present invention recited in the claims attached hereto. According to the present invention or the various aspects, or to the various embodiment as set force above in the specification, the desired purposes can be achieved. Namely, at least one of the matters as set force below can be realized.

It is possible to provide a liquid container which has high containing efficiency and which is compact and more effective. Since ink is directly reserved without using a porous body, a liquid container can be provided from which ink can preferably move and which has high negative pressure stability, high durability, and high productivity.

Since ink is directly contained in an ink tank without using a porous body to allow ink to be supplied to a head at a high speed, an ink tank having high volumetric efficiency and stable negative pressure characteristics can be manufactured.

Since ink is directly contained, ink has more freedom to move, and there is smaller loss of the pressure of ink that is passing through a filter. This makes it possible to provide an ink tank that is adapted to higher speeds, a greater number of nozzles, and higher image quality.

It is possible to provide an ink tank having a structure which exhibits high durability even when ink is repeatedly charged and used and which has excellent ink utilization and does not affect the ejecting performance of a printing head. The invention also contributes to configuration of an inkjet printing head and printing apparatus capable of a stable ejecting operation.

Even when a plurality of ink types are used, a plurality of ink tanks can be provided close to each other without interposing any partition or partition wall between them, which makes it possible to provide an ink tank container that is compact and simple in configuration. This also contributes to configuration of a compact inkjet printing head and printing apparatus.

Since ink tanks are disposed in a positional relationship which results in no interference between the ink tanks, there will be no loss in ink supplying characteristics of each ink tank and ejecting characteristics of a head. In addition, since a plurality of ink tanks are contained in an ink tank container or chamber that is in communication to the outside only through a small suction/exhaust port, processes (such as discharging of residual gases and ink charging) for maintaining good ink supplying characteristics of the ink tanks by pressurizing or depressurizing the interior of the container can be performed with a simple configuration.

The use of a film having excellent gas blocking properties makes it possible to prevent gases from entering easily. This suppresses an increase of an internal pressure of the liquid container and also suppresses evaporation, thereby allowing any increase of the density of the liquid in the container to be suppressed.

Negative pressure characteristics that are a relationship between the amount of extracted ink or liquid and changes in a negative pressure include a first region and a second region having a smaller rate of change of the negative pressure than that in the first region. Tapered or curved side sections of movable members are deformed a convex feature as ink is extracted, and the top of the convex feature is displaced against a force exerted by a negative pressure generating unit. This makes it possible to cause a great increase of the negative pressure at an initial phase of ink extraction or in the first region and to achieve a predetermined negative pressure for supplying ink by extracting a relatively small amount of ink.

Since the movable members have a convex configuration with a planar top section, they always form a constant shape as a result of deformation, which makes it possible to cause displacement that is always consistent.

This makes it possible to prolong a region in which ink can be supplied with a negative pressure in a predetermined preferable range and to achieve stable negative pressure characteristics.

A printing apparatus embodying the invention may be configured separately from a computer that creates and processes data such as images associated with printing, a reader section for reading images, or an image data supply source in the form of a digital camera, for example. It may also be configured separably or inseparably and integrally with such an apparatus.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid container for reserving a liquid to be supplied to the outside, comprising:

a flexible sheet member that forms a part of the container and that includes a section molded in a convex shape;

a fixing member that forms a part of said container and that is a member for fixing said sheet member at a peripheral section thereof, said fixing member having an opening to allow the liquid to be extracted to the outside;

a spring member provided in the section of said sheet member with the convex shape;

a planar member disposed on a section of the convex shape of said sheet member; and a deformable region placed between said fixing member and said planar member of said sheet member and deformed according to extraction of the liquid, wherein said spring member deforms after a deformation of said deformable region when ink extraction starts from an initial state of said liquid container.

2. A liquid container as claimed in claim 1, wherein said fixing member has a frame that is compliant with the shape of the peripheral section of said sheet member and that is joined to the peripheral section and wherein said sheet member is disposed in at least either of a pair of openings of said frame facing each other.

3. A liquid container as claimed in claim 2, wherein both of respective contact surfaces of said sheet member and said frame have planarity and wherein said contact surfaces are joined and fixed to each other.

4. A liquid container as claimed in claim 2, wherein a feature for moderating a reaction force against deformation of said sheet member is provided at least in a part of said sheet member between the surface of said top section and said frame.

5. A liquid container as claimed in claim 4, wherein the feature for moderating the reaction force against deformation is a curved feature.

6. A liquid container as claimed in claim 4, wherein the feature for moderating the reaction force against deformation is a feature having a plurality of steps that are in parallel with said top surface.

7. A liquid container as claimed in claim 4, wherein the feature for moderating the reaction force against deformation is a multiplicity of planes formed at a ridge of the convex feature.

8. A liquid container as claimed in claim 1, wherein said planar member is displaced in accordance with displacement of said sheet member toward the interior of said container as a result of a reduction in an amount of reserved liquid while suppressing deformation of a surface, and wherein said planar member is displaced along with said spring member in contact with said spring member.

9. A liquid container as claimed in claim 8, wherein said planar member and said spring member are fixed to each other and provided in said container.

10. A liquid container as claimed in claim 9, wherein said spring member has a pair of leaf springs having a substantially U-like configuration and wherein the pair of leaf springs are combined such that they face each other at open sides thereof and such that they are engaged with each other at both ends thereof.

11. A liquid container as claimed in claim 10, wherein the pair of leaf springs are combined by engaging a concave portion and a convex portion that fit each other and that are formed at the both ends of each said springs.

12. A liquid container as claimed in claim 11, wherein said leaf springs are formed with a curvature and wherein the amount of deflection of the ends of said convex portion and said concave portion relative to a tangent line extending from the base of said convex portion and the base of the opening of said concave portion on a curved surface formed in the acting direction of an urging force of said leaf springs is greater than 0 and not greater than the thickness of said leaf springs.

13. A liquid container as claimed in claim 10, wherein said planar member and said leaf spring are formed integrally by welding separate members.

14. A liquid container as claimed in claim 10, wherein said planar member and said leaf spring are formed by processing a single plate-like material.

15. A liquid container as claimed in claim 1, wherein an outer surface of said fixing member is protected with a material having high gas blocking properties.

16. A liquid container as claimed in claim 15, wherein the outer surface of said fixing member is protected with a multi-layer film member formed by stacking a plurality of film members and bonding them each other and wherein at least one layer of the multi-layer film member is made of a material having gas blocking properties higher than those of the material of said fixing member.

17. A liquid container as claimed in claim 16, wherein a layer of said multi-layer film member to serve as a surface to be joined with said fixing member is made of the same material as that of said fixing member and wherein said multi-layer film member is joined to said fixing member using thermal welding.

18. A liquid container as claimed in claim 16, wherein a layer of said multi-layer film member to serve as a surface to be joined with said fixing member is made of a material different from that of said fixing member and wherein said multi-layer film member is joined to said fixing member using bonding.

19. A liquid container as claimed in claim 15, wherein the outer surface of said fixing member is constituted by a single layer film member having high gas blocking properties.

20. A liquid container as claimed in claim 15, wherein at least a part of the material having high gas blocking properties is the same as the material of said sheet member.

21. A liquid container as claimed in claim 15, wherein at least a part of the outer surface of said fixing member is covered by the sheet member itself.

22. An inkjet head cartridge comprising:

an inkjet head for ejecting ink; and a liquid container as claimed in claim 1 for reserving ink to be supplied to the inkjet head.

23. A liquid container as claimed in claim 1, wherein said fixing member has a second opening for introducing a liquid to be reserved into said container.

24. An ink tank unit comprising a plurality of liquid containers as claimed in claim 23 without interposing partitions therebetween to contain ink in each of them independently.

25. An ink tank unit as claimed in claim 24, wherein the plurality of liquid containers are provided in positions and sizes such that no mutual interference occurs when said sheet members is displaced until ink charging through said second opening is completed for each of them.

26. An ink tank unit as claimed in claim 24, further comprising a communication section for allowing the space containing the plurality of liquid containers to communicate with the outside only through itself.

27. An ink tank unit as claimed in claim 26, wherein each of the plurality of liquid containers is charged with ink by depressurizing the space through said communication section to displace said sheet member in the direction of increasing the internal volume of each of said liquid container and wherein supply of ink to said printing head is enabled by exposing the space to the atmosphere through said communication section to allow said sheet member to be displaced in the direction of decreasing the internal volume of each of said liquid containers.

28. An inkjet cartridge comprising:

a plurality of inkjet heads for ejecting ink; and an ink tank unit as claimed in claim 24 having a plurality of said liquid containers associated with the plurality of said inkjet heads.

29. A liquid container for supplying a liquid to the outside and for reserving the liquid, comprising:

a movable member molded in a convex shape defining at least part of said container, said movable member being made of a flexible sheet material; and a negative pressure generating means for applying a force to said movable member to deform it in a direction opposite to the direction in which said movable member is deformed as the liquid is supplied, thereby maintaining a negative pressure in said container relative to atmosphere, wherein negative pressure characteristics that are a relationship between the amount of liquid extracted and changes in the negative pressure generated by the negative pressure generating means include a first region and a second region having a rate of change of the negative pressure smaller than that in said first region; and wherein said first region is formed by deformation of said movable member and said second region is formed by deformation of said negative pressure generating means.

30. A liquid container as claimed in claim 29, wherein said first region is a region in which the amount of extracted liquid is greater than 0 cc and is not greater than 0.5 cc.

31. A liquid container as claimed in claim 29, wherein said first region is a region in which the amount of extracted liquid is greater than 0% and is not greater than 10% of the capacity of said liquid container.

32. A liquid container as claimed in claim 29, wherein the negative pressure characteristics further include a third linear region adjacent to said second linear region and wherein the rate of change in said third linear region is greater than the rate of change in said second linear region.

33. A liquid container as claimed in claim 29, wherein said negative pressure generating means generates a negative pressure by exerting a force using a spring.

34. A liquid container as claimed in claim 33, wherein the negative pressure characteristics in said first linear region depend on deformation of said movable member and wherein the negative pressure characteristics in said second linear region depend on the elasticity of said spring.

35. An inkjet cartridge comprising:

an inkjet head for ejecting ink; and a liquid container as claimed in claim 29 for reserving ink to be supplied to said inkjet head.

36. A liquid container for reserving a liquid to be supplied to the outside, comprising:

a flexible sheet member that forms a part of the container and that includes a section molded in a convex shape;

a fixing member that forms a part of said container and that is a member for fixing said sheet member at a peripheral section thereof;

an opening that allows the liquid to be extracted to the outside;

a spring member provided in the section of said sheet member with the convex shape;

a planar member formed with the section of said sheet member with the convex shape; and a sheet movable area disposed between said fixing member and said planar member of said sheet member;

wherein said spring member deforms after a deformation of said movable sheet area when ink extraction starts from an initial state of said liquid container.

* * * * *